US005203425A

United States Patent [19]

Wehmeyer

[11] Patent Number: 5,203,425

[45] Date of Patent: Apr. 20, 1993

[54] PERSONNEL LIFT DEVICES

[76] Inventor: Donald T. Wehmeyer, 5522 218th Ave. E., Sumner, Wash. 98390

[21] Appl. No.: 668,961

[22] Filed: Mar. 13, 1991

[51] Int. Cl.[5] ..... E04G 5/00

[52] U.S. Cl. ..... 182/19; 182/148; 182/113; 182/63

[58] Field of Search ..... 182/148, 113, 19, 141, 182/63

[56] References Cited

U.S. PATENT DOCUMENTS

| | | | |
|---|---|---|---|
| 3,910,370 | 10/1975 | Mecklenburg et al. | 182/148 X |
| 4,467,888 | 8/1984 | Heckling | 182/113 X |
| 4,498,556 | 2/1985 | Ganton | 182/148 X |
| 4,787,111 | 11/1988 | Pacek et al. | 182/148 X |

*Primary Examiner*—Alvin C. Chin-Shue

[57] ABSTRACT

The present invention provides personnel lift devices that include at least one of six design features. Each of the design features is discussed individually. The lift device includes an operator's cage assembly exhibiting ease of operator access and a safety enhancing interlocked design. A control mechanism, requiring the use of both hands to maneuver the controlled device, further enhances the safety of apparatus of the present invention. Interlocked outriggers provide enhanced structural stability and safety. A telescoping mast of extruded metal design includes a plurality of tee slots and/or sliding engagement during extension and retraction of the individual mast stages. A transfer mechanism releasably positionable at a plurality of heights and includes a bumper/roller assembly that is either fixed or freely movable, depending upon the portion of the device being transferred that is bearing the weight thereof.

6 Claims, 13 Drawing Sheets 30
32
34
36
36a
36b
36c
36d
36e
36f
38
40
42
44
46
48
50
52
54
56
58
60
62
64
66
68
70

PERSONNEL LIFT DEVICES

TECHNICAL FIELD OF THE INVENTION

The present invention relates generally to mobile work platforms for construction and maintenance projects to be conducted at heights greater than that of the person responsible for the task. Specifically, the present invention relates to personnel lift devices that are safe, easy to manufacture and maintain, and readily transferable between two essentially horizontal surfaces disposed at different heights.

BACKGROUND OF THE INVENTION

Various designs of mobile work platforms capable of vertically lifting personnel are known in the art. Telescoping mast personnel lift devices are commercially available from Genie Industries, Redmond, Wash., for example. In those devices, a base frame of fabricated aluminum supports an aluminum telescoping mast, including five or six stages interconnected by chains. When extended, the telescoping mast elevates an operator's cage that is designed for ground level entry. The operator's cage of this prior art lift design is shown in FIG. 1.

A cage assembly 10 is formed with a completely enclosed lower portion 12 and a completely enclosed upper bar 14 connected by a plurality of vertical connecting bars 16. Approximately at the lengthwise midpoint of vertical connecting bars 16, a plurality of horizontal safety bars 18*a*, 18*b*, 18*c*, and 18*d* are deployed. Horizontal safety bars 18*a*, 18*b* and 18*c* are permanently affixed to their respective next adjacent vertical connecting bars 16. In contrast, a horizontal access bar 20 is equipped with a set of two securing loops 22. Securing loops 22 enclose the vertical connecting bars 16 positioned adjacent to access bar 20, and securing loops 22 rest upon next adjacent horizontal connecting bars 18*a* and 18*c*. As a result, horizontal access bar 20 may be moved vertically in the direction indicated by arrow A to allow operator access to cage assembly 10.

This manner of operator access is awkward, requiring the operator to simultaneously lift access bar 20, pass under upper bar 14 and step over lower portion 12. The awkwardness of operator access to cage assembly 10 leads some operators to secure horizontal access bar 20 to upper bar 14. As a result, the operator will be able to have both hands free when gaining access to cage assembly 10. Such altered deployment of horizontal access bar 20, when continued during operation of the personnel lift, decreases the safety of the lift, however.

To lift cage assembly 10, an electric motor powers a hydraulic fluid pump to deliver working fluid pressure to a hydraulic cylinder. Since the hydraulic cylinder is attached to the base frame and the mast, extension of the cylinder results in elevation of the mast. A dual chain system operates to sequence the extension of the individual mast stages to achieve the desired height of cage assembly 10.

In conventional personnel lift devices, the operator may control (i.e., raise or lower cage assembly 10) with one hand. Specifically, the control box used with the personnel lift is designed such that actuation of a single control results in cage assembly 10 movement. As a result, the operator may raise or lower cage assembly 10 while leaning out over the edge thereof. This uneven distribution of the operator's mass during cage assembly 10 movement is a destabilizing factor that decreases the safety of the personnel lift.

Equipment production costs are affected by the amount of machining required. Operations, such as drilling holes in structures to permit bolt or screw access during assembly and the like, increase manufacturing complexity and therefore the time required for and the cost of such manufacturing. Masts of prior art devices, for example, have a plethora of holes machined therein to accommodate attachment of cable sheaves, studs of various types, brackets, braces, and the like as well as to permit mast assembly.

In addition, the mast of the prior art device features tracks, within which each mast stage travels to raise or lower the operator's cage. Each mast stage is equipped with a plurality of rollers to facilitate the movement of the mast stage within its tracks. This roller/track configuration requires a significant amount of machining. In addition, roller/track engagement may result in structural instability resulting from concentrated stress.

For maximum safety in operation, four removable outriggers, equipped with screw jacks on the outboard end thereof, should be deployed such that the base of the personnel lift device is level. This personnel lift device can, however, be operated without outriggers. Consequently, an operator faced with a single, discrete task may be tempted to forego outrigger use and attempt to complete the task using the lift device in an unsafe fashion.

A recognized problem with personnel lift devices is the difficulty in transferring them between essentially horizontal surfaces at varying heights (i.e., loading the lift from the ground onto the bed of a truck). A feature of the prior art apparatus previously under discussion addresses this concern. In that prior art design, a pivot point is adjustable to accommodate variations in vertical distance between the essentially horizontal surfaces. A stop with a pull pin is used to prevent a wheel associated with the pivot point from moving up the mast when the lift device is tilted. The wheel is permitted to move down the mast (through a roller/track system) as the lift device is being shifted horizontally at the new height. In this manner, the transfer operation may be carried out in reverse to lower the lift device to its original vertical level without any adjustment by the transferor. This feature is especially useful where the vertical transfer of the lift device constitutes temporary storage for transportation to another work site or until use thereof is again required. An analogous, dual pivot, slide block design is also commercially employed for this purpose. The battery compartment of each of these lift devices is disposed at a location that would interfere with this transfer process and must therefore be removed prior to transfer.

In a different design, a fixed set of wheels is located along the rear of the mast (i.e., the side of the mast opposite the side that is adjacent to the operator's cage). The set of wheels acts as the point about which the personnel lift device is pivoted when it is being transferred from one essentially horizontal surface to another. The position of the wheels along the mast is not adjustable and therefore the configuration represents the optimal design (i.e., requires the least force to effectuate the transfer) for transfers through one specific vertical distance only. Moreover, the battery pack compartment of this lift device is also disposed, such that it must be removed prior to transfer.

U.S. Pat. No. 4,709,784 describes an alternative loading facilitation mechanism, where a surface engaging pivot is deployed adjacent to a wheel on a single carriage. In this manner, the personnel lift device is pivoted about the surface engaging pivot until the lift is approximately horizontal. The surface engaging pivot is maintained in place on the higher horizontal surface throughout the pivoting operation by friction. At the end of the pivoting operation (i.e., when the lift is approximately horizontal), the wheel adjacent to the pivot is engaged and the lift can be rolled along the higher horizontal surface. The pivot/wheel assembly is mounted on a bracket and is height-adjustable through a mechanism including a plurality of adjustment holes located in a spaced-apart relationship along the side of the lift. The bracket has a key receiving hole therein capable of accepting a key, allowing the bracket to be affixed at a desired height when the key is placed through the bracket and one of the adjustment holes.

SUMMARY OF THE INVENTION

The present invention provides an improved personnel lift device characterized by at least one of six design features. In addition, the present invention contemplates the use of these design features in other devices having design concerns similar to those of personnel lift devices that are addressed by the design features.

The present invention provides an operator's cage assembly that is characterized by easy operator access and an interlocked design for enhanced safety. Specifically, the case assembly of the present invention must be closed before the operator can move the cage assembly. When used with a personnel lift, for example, the cage assembly of the present invention cannot be elevated unless that assembly is closed, thereby securing the operator. Similarly, such a lift cage assembly of the present invention cannot be opened when elevated.

The apparatus of the present invention may also be characterized by a dual hand operated control box for enhanced stability and safety. Because the operator of an apparatus of an embodiment of the present invention incorporating this feature is required to use both hands to maneuver the apparatus, the operator's mass will likely be centered above the cage assembly during operation. By locating the center of mass of an operator over the portion of the apparatus to be moved during operation, destabilization of the apparatus resulting from the operator's mass is lessened.

For devices that perform functions requiring deployment surface-level structural stability, the present invention provides a stabiilzing system of interlocked design for enhanced safety. Specifically, the outriggers of the present invention must be operably connected at one end thereof to the base of the device in a proper manner, and the jacks disposed at the opposite end of each outrigger must be adjusted, such that the jack is in contact with the deployment surface. Only when both of these conditions are met can the device perform a function requiring outrigger stability (i.e., elevating the cage assembly of a personnel lift device).

The mast of the present invention is composed of a plurality of stages that are preferably formed by an extrusion process. Such metallic extrusions include a plurality (i.e., three for each telescoping mast stage) of tee slots disposed along the outer surface of each stage of the mast. In this manner, components may be affixed to the outside of the mast, without the machining necessary for drilling holes to facilitate bolt or screw placement. Formed integrally with each tee slot is a U-slot or an analogous structure. Each mast section of a preferred embodiment of the present invention includes two essentially rectangular extensions designed to fit loosely within U-slots. Consequently, the mast of the present invention may also be assembled, without the machining necessary to facilitate bolt or screw placement.

In addition, the mast of the present invention utilizes a thin strip of low-friction material to provide sliding engagement within the mast structure. This strip of material is placed between the U-slots and the rectangular extensions when used in a preferred embodiment of the present invention. Sliding engagement imparts more stability to the mast by increasing the contact area between the exterior mast portion (the rearwardly disposed stage exhibiting the U-slot) and the interior mast portion (the forwardly disposed stage exhibiting the rectangular extension) Moreover, a device employing sliding engagement requires less machining to produce than does an apparatus with other engagement mechanisms involving relative component motion, such as a roller/track mechanism. These mast features may be employed, either alone or in combination, in any device in which a telescoping mast is used.

The present invention also provides a mechanism capable of assisting in the transfer of the device between substantially horizontal surfaces disposed at different heights. Specifically, the device includes a bumper-like component operably connected to a system of rollers. The bumper/roller assembly is releasably positionable at a plurality of heights to accommodate a variety of transfers and operates in cooperation with a set of wheels located at the rear portion of the device to be transferred. The bumper/roller assembly is freely movable when the weight of the device being transferred is placed on the bumper and maintains a fixed position when the weight of the device being transferred is on the upper set of wheels.

FIGS. *7a*, *7b*, *7c* and *7d* are top views of a mechanical, mast interlock system of the present invention, with FIGS. *7a* and *7c* depicting the interlocking system in a closed configuration, FIGS. *7b* and *7d* depicting the interlocking system in an open configuration, and FIGS. *7c* and *7d* depicting an added safety feature.

Figure 8:
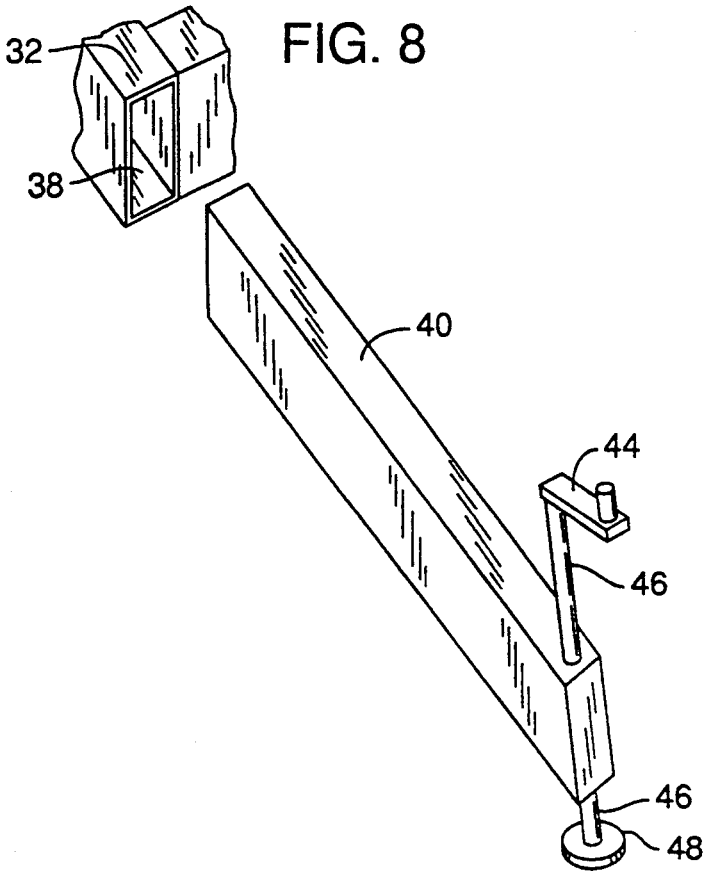

FIG. 8 is an exploded, fragmentary view of an embodiment of a portion of the stabilization system of the present invention.

Figure 9A:
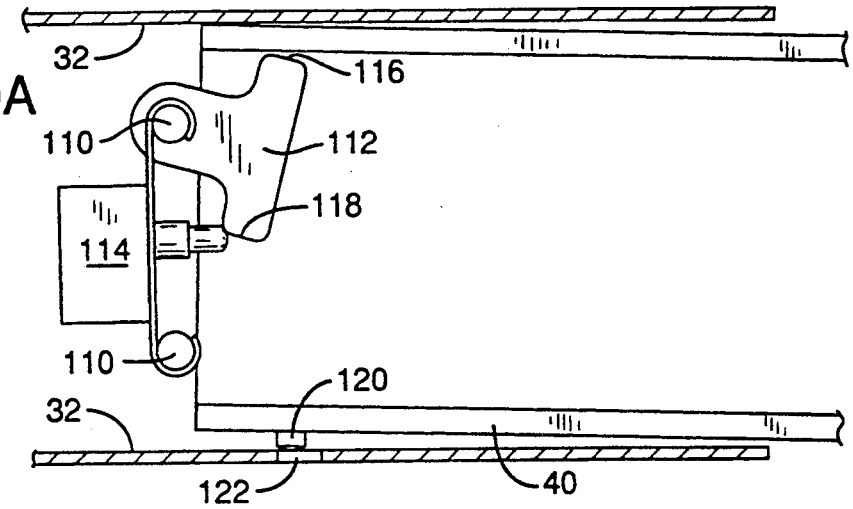
Figure 9B:
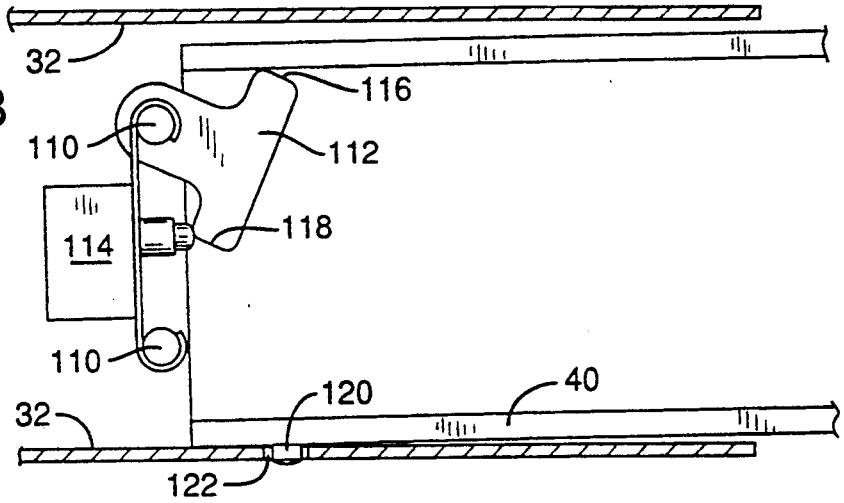

FIGS. *9a* and *9b* are side views of a mechanical/electrical interlock of the stabilization system of the present invention, with FIG. *9a* depicting a non-interlocked outrigger placed within the base and FIG. 9*b* depicting an interlocked outrigger.

Figure 10:
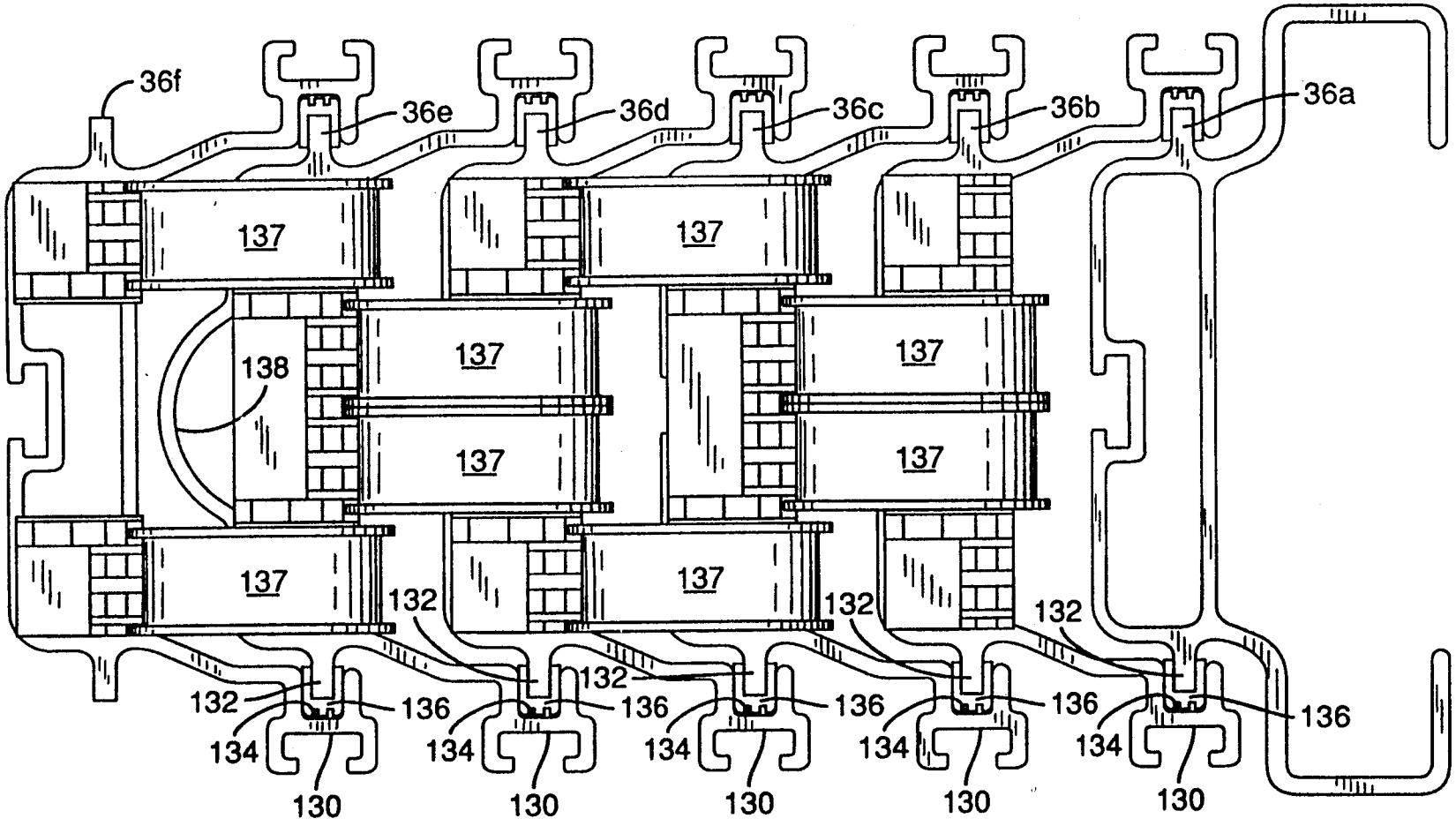

FIG. 10 is a top view of an embodiment of the mast of the present invention.

Figure 1:
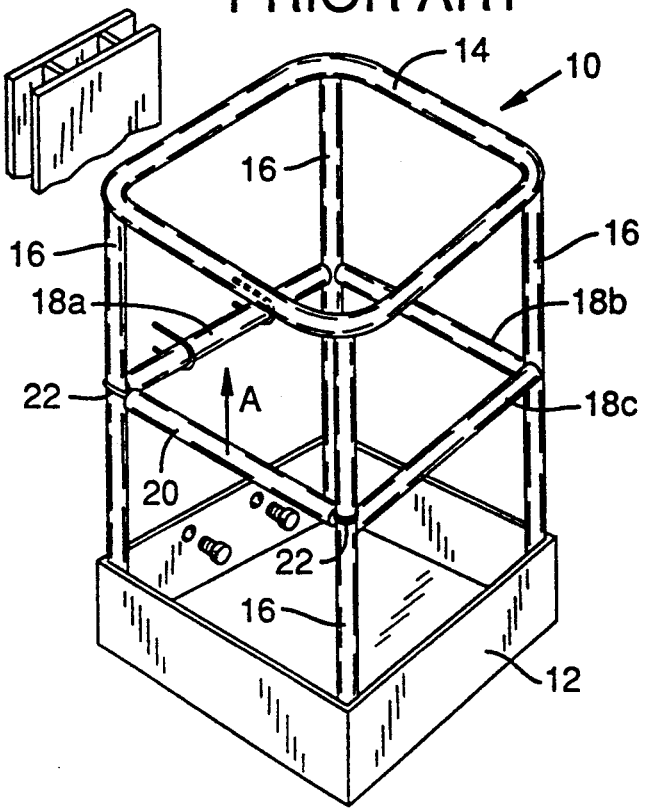
FIG. 1 PRIOR ART
FIG. 1 is an isometric view of a prior art operator's cage assembly.
Figure 11:
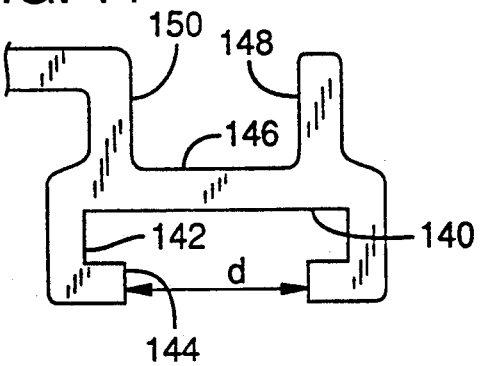

FIG. 11 shows a fragmentary top view of an integral tee slot/U-slot mast component structure of the present invention.

Figure 12:
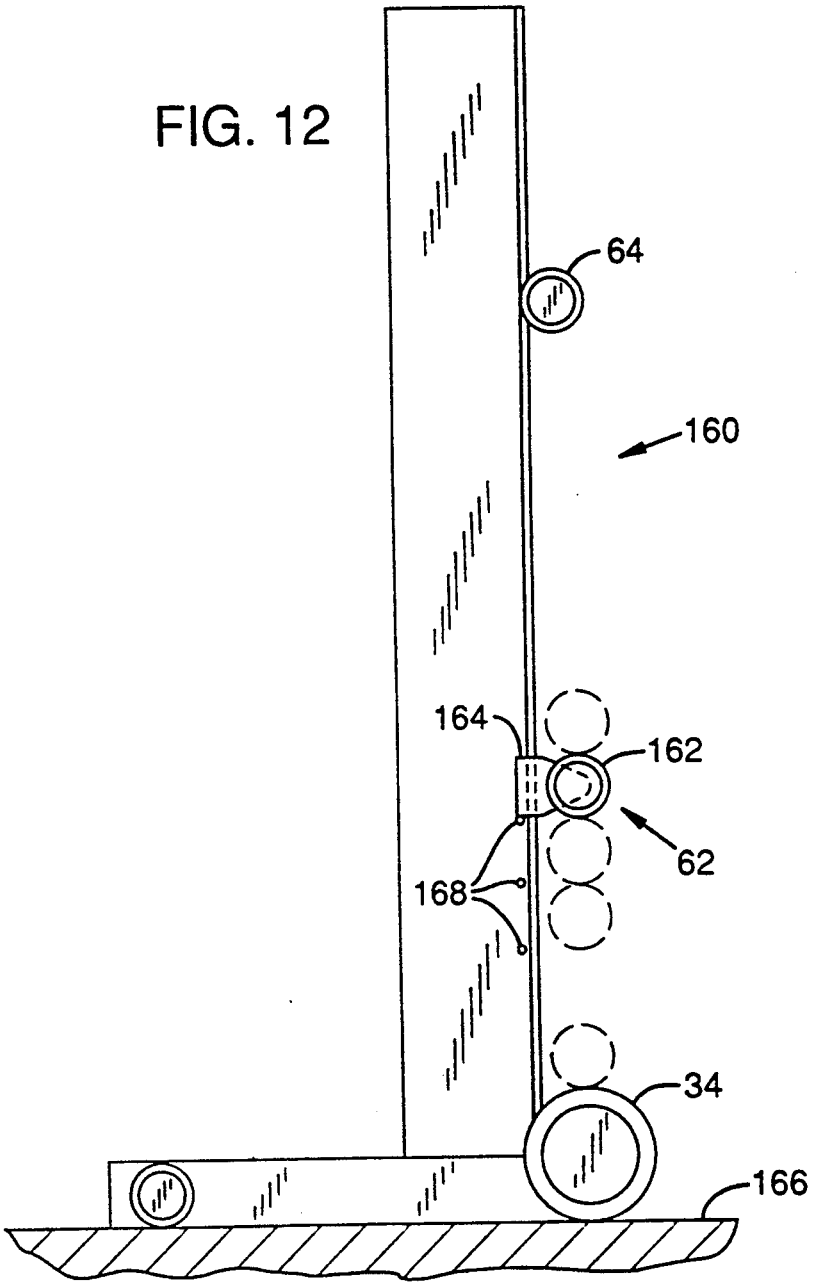

FIG. 12 is a side view schematic representation of the components of an embodiment of the transfer apparatus of the present invention mounted on the device to be transferred.

Figure 13:
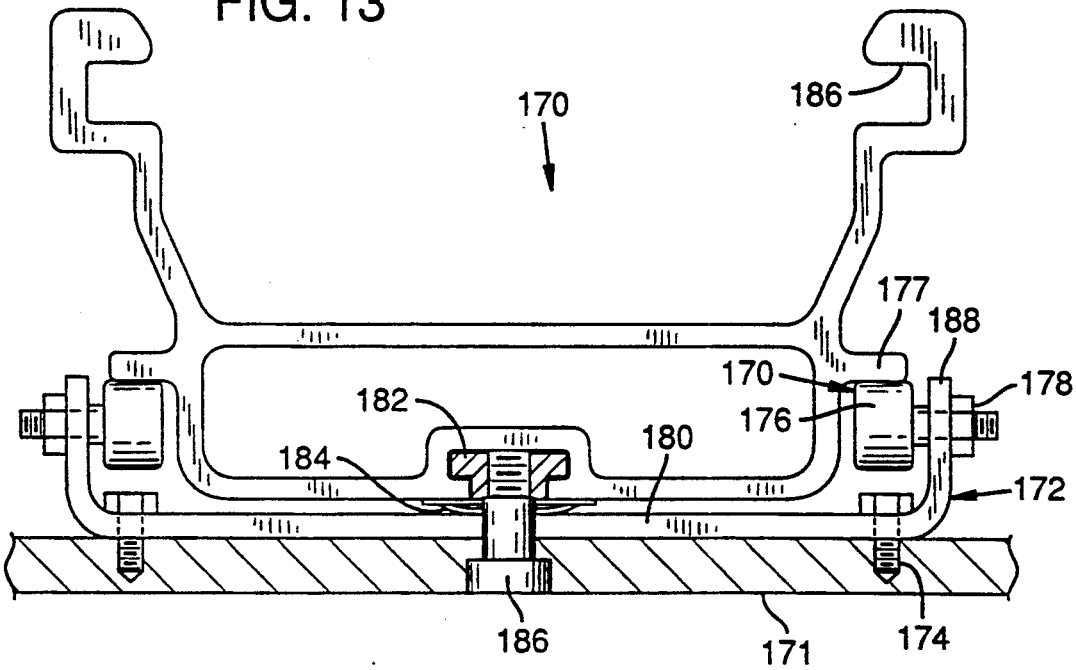

FIG. 13 shows a preferred embodiment of the transfer bumper mount of the present invention mounted on the device to be transferred.

Figure 14:
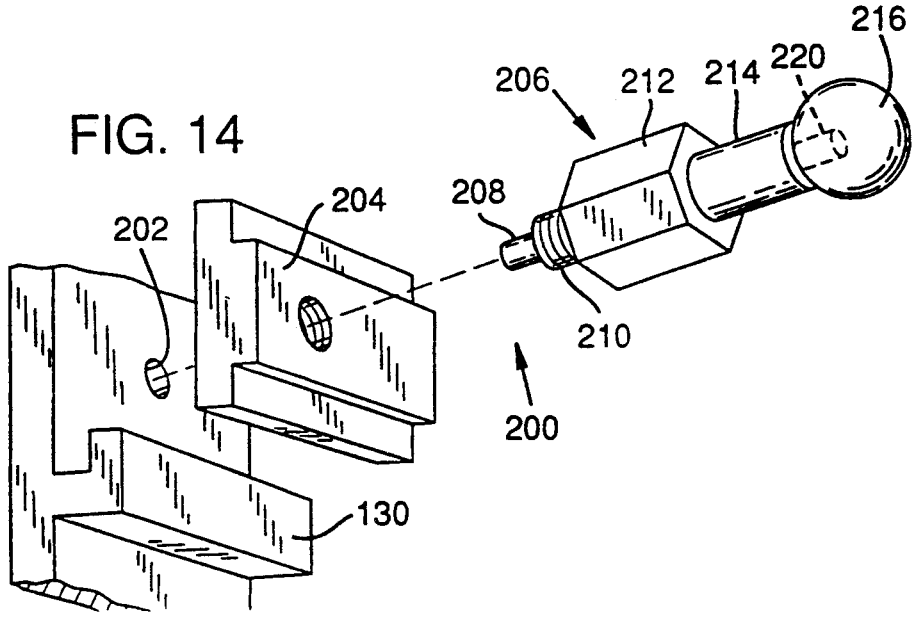

FIG. 14 is a partly exploded schematic representation of a limiting assembly and a rearward tee slot of the present invention.

Figure 15:
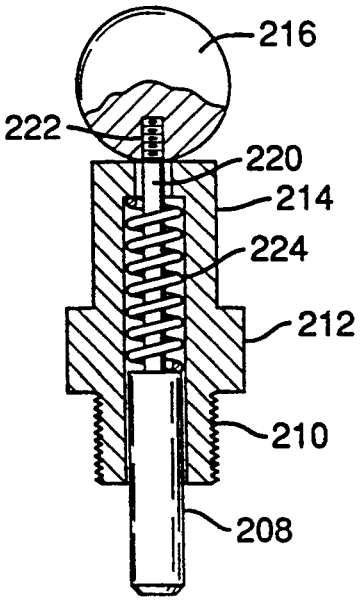

FIG. 15 is a sectional view taken along line 15—15 of FIG. 14 showing a limiting assembly of the present invention.

Figure 16A:
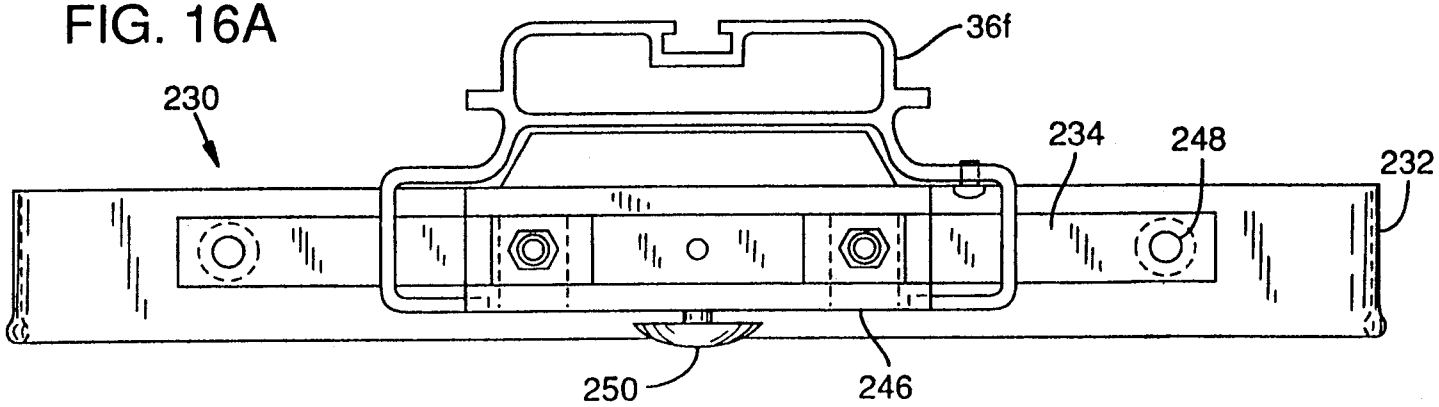
Figure 16B:
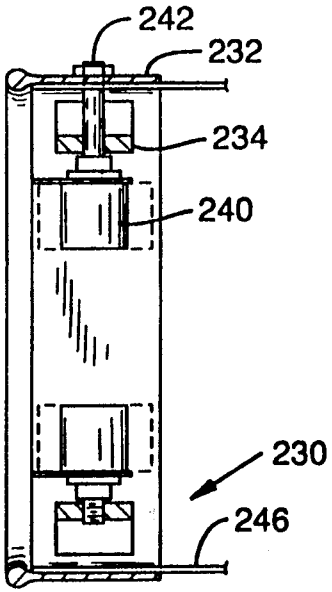
Figure 16C:
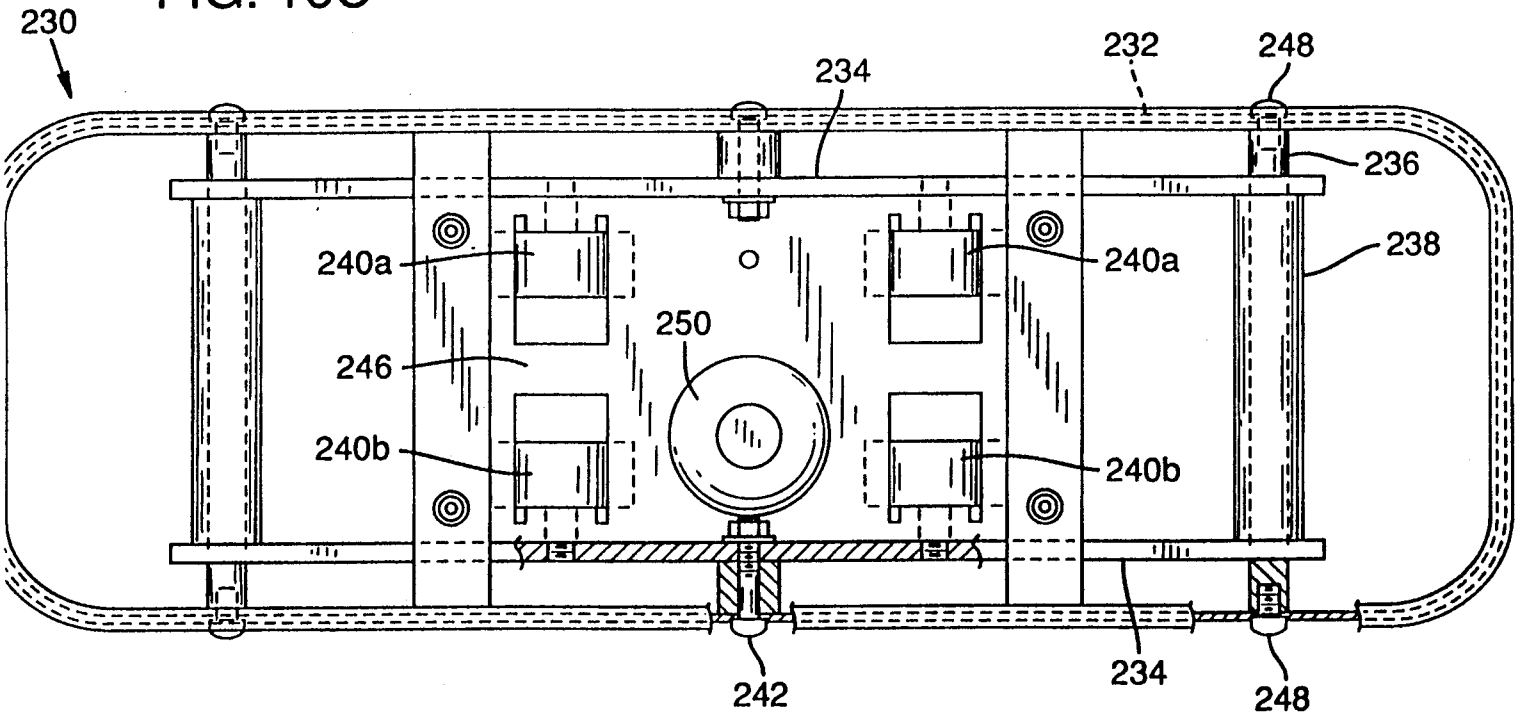

FIGS. 16*a*, 16*b* and 16*c* respectively represent a top view, a sectional view taken along line 16*b*—16*b* of FIG. 16*a* and a sectional view taken along line 16*c*—16*c* of FIG. 16*a* of the control box of the present invention.

Figure 17:
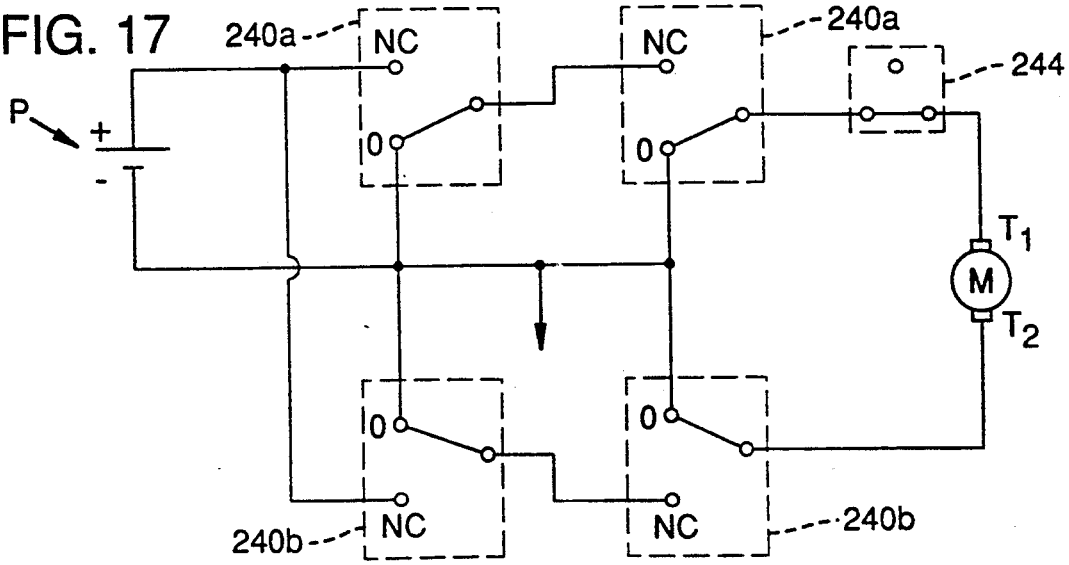

FIG. 17 shows an electrical circuit diagram of the control mechanism of the present invention in the "rest" configuration.

DETAILED DESCRIPTION OF PREFERRED EMBODIMENT

For the purposes of this description, the term "front" shall mean the side of the personnel lift device on which the operator enters. The term "rear" shall mean the side opposite the front, and the terms "right" and "left" shall mean the operator's right and left as the operator enters the personnel lift. Adjectives such as "upper" and "lower" refer to those directions when the device of the present invention is deployed for use rather than being transported or stored.

Figures 2, 3, 4:
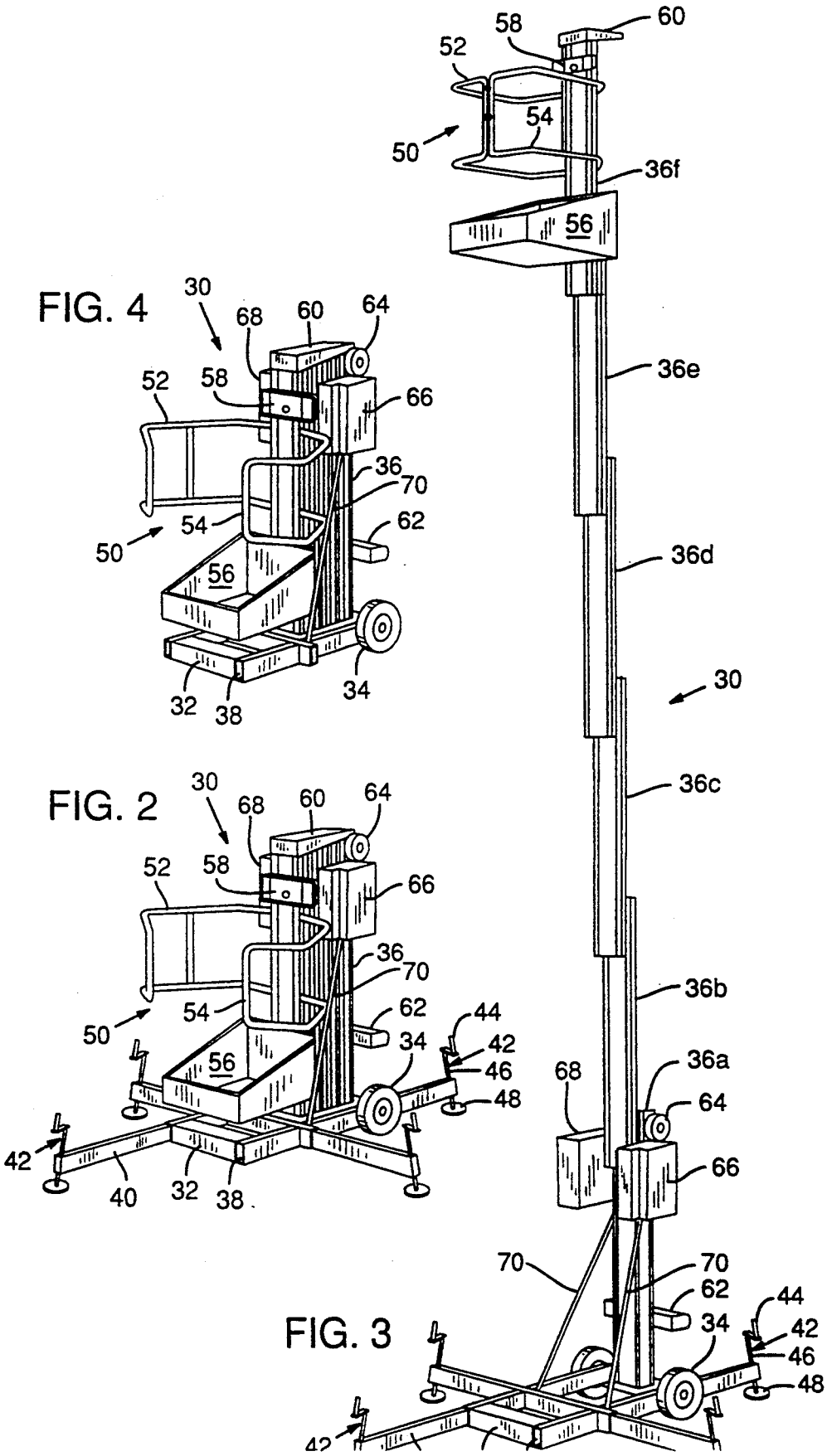
FIG. 2 is an isometric view of a personnel lift device of the present invention with outriggers deployed and cage assembly open for operator entry and subsequent mast extension.
FIG. 3 is an isometric view of a personnel lift device of the present invention with its mast extended.
FIG. 4 is an isometric view of a personnel lift device of the present invention in a position suitable for transportation, storage, or outrigger deployment.

A personnel lift 30 of the present invention is depicted in FIGS. 2, 3 and 4. While the features of the present invention are described in the personnel lift context, a practitioner in the mechanical arts will appreciate that the features described herein may be useful in other equipment having design problems or concerns similar to those of personnel lift devices.

Personnel lift 30 is shown in FIG. 2 in a configuration prerequisite to operator entry and lift 30 use. A base 32 is operably connected at its rear end to a set of wheels 34 that facilitate movement of lift 30 along the surface upon which it is deployed, such as a gymnasium floor. As is more easily seen in FIG. 3, base 32 supports a rear fixed stage of a telescoping mast 36 and includes a plurality of hollow shafts having deployment openings 38. Each deployment opening 38 is designed to receive one end of an outrigger 40, having a jack 42 disposed at the opposite end thereof. To be used in the present invention, jack 42 or an analogous device is operably connectable to outrigger 40 such that adjustment of jack 42 will pivot outrigger 40. Exemplary jacks useful for this purpose are screw jacks, turn-down jacks, floor locks, and the like, which are known and commercially available.

Each jack 42 includes a crank 44, a shaft 46 and a base portion 48. Jack 42 may be designed such that the end of outrigger 40 at which jack 42 is deployed is moved downward when the crank is turned in the clockwise direction or vice versa. Jack 42 and outrigger 40 must be operably connected such that jack 42 is capable of pivoting outrigger 40 until base portion 48 firmly contacts the personnel lift 30 deployment surface.

A preferred design features six deployment openings 38 arranged as follows: two forward (i.e., frontward) openings 38 disposed at either end of base 32; two rearward openings 38 disposed at either end of base 32; one leftward opening 38 disposed at the approximate midpoint along the left side of base 32; one rightward opening 38 disposed at the approximate midpoint along the right side of base 32. Each deployment opening 38 corresponds to an open end of a hollow shaft within the structure of base 32. When using a lift 30 of the preferred design, four outriggers 40 are typically employed, one directed rightward; one directed leftward; one directed forward and located at one end (i.e., right or left) of base 32; and one directed rearward and located at the other end (i.e., left or right) of base 32.

An operator's cage 50, including a left guardrail portion 52, a right guardrail portion 54, and a platform 56, is affixed to a front stage of telescoping mast 36. Since cage assembly 50 is in an open configuration in FIG. 2, mast 36 cannot be extended. Also affixed to the front stage of mast 36 is an operator's control panel 58 and a mast cover 60. Affixed to a rear stage of telescoping mast 36 is a transfer bumper 62, at least one, preferably two, upper transfer wheels 64, a power module 66 and a battery module 68.

FIG. 3 depicts personnel lift 30 in an extended configuration for use. Specifically, left guardrail portion 52 and right guardrail portion 54 are closed, thereby securing the operator within cage assembly 50. For reasons described later, guardrail portions 52 and 54 cannot be opened while lift 30 is in this configuration. Mast 36 is shown with a plurality of mast stages 36*a* (i.e., the rear fixed stage), 36*b*, 36*c*, 36*d*, 36*e* and 36*f* (i.e., the front stage). Rear mast stage 36*a* is additionally stabilized by at least one, preferably two, stabilizer bars 70, affixed at one end to mast stage 36*a* and at the other end to base 32. Other structure stabilizing means may be employed in addition to or in place of stabilizer bars 70.

FIG. 4 shows personnel lift 30 in an open, non-stabilized configuration for transportation, storage or outrigger deployment. Mast 36 cannot be extended while lift 30 is in this configuration.

Figure 5:
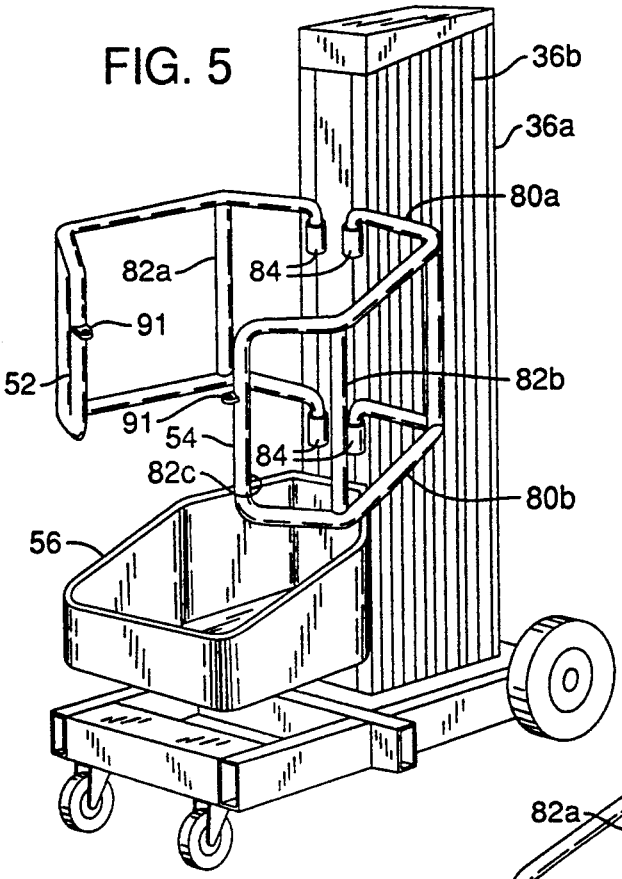
FIG. 5 is an isometric view of the cage assembly of the present invention in an open configuration.
Figure 6:
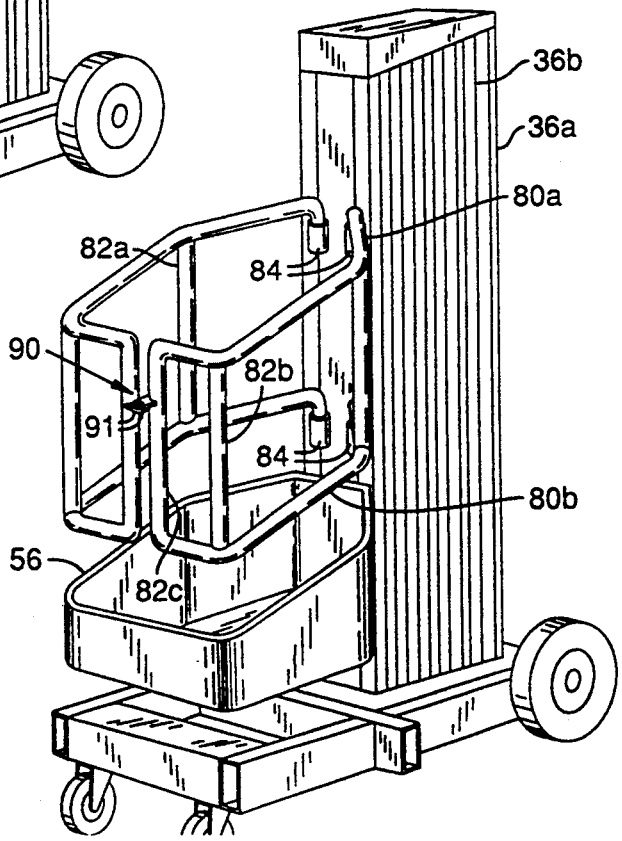
FIG. 6 is an isometric view of the cage assembly of the present invention in a closed configuration.

Cage assembly 50 of the present invention is shown in FIGS. 5, 6 and 7. Platform 56 may be formed of any convenient material or combination of materials, with durable light-weight materials of sufficient strength to bear the weight of an operator and whatever equipment the operator may require. Preferred materials are thermally formed plastic, fiberglass, aluminum, and the like. Also, the platform may be of any convenient shape and size, allowing the operator sufficient maneuverability to complete the tasks requiring cage assembly 50 elevation. Exemplary sizes are 28.5"×22" and the like. A practitioner in the art would be able to determine an appropriate platform material and configuration.

Left and right guardrail portions 52 and 54 may be formed of any convenient material or combination of materials, with durable light-weight materials of sufficient strength to provide security to an operator enclosed therein preferred. Exemplary materials are aluminum, steel, composites, and the like. The individual bars of left guardrail portion 52 and right guardrail portion 54 are preferably composed of tubular aluminum and arranged in a modified hexagon when closed, as shown in FIG. 6. Each guardrail portion 52 and 54 preferably includes a set of two bars disposed in horizontal planes, 80*a* and 80*b*, and a set of three bars disposed in vertical planes, 82*a*, 82*b* and 82*c*.

Also, guardrail portions 52 and 54 are hinged along a vertical axis through one or more pivots 84. Pivots 84 on guardrail portions 52 and 54 are operably connected to a fastening means designed to engage mast stages 36*a* and 36*b*. When cage assembly 50 is in an open configuration allowing operator access thereto, mast 36 is mechanically interlocked to prevent telescoping or retraction thereof in the manner described below. In contrast, the mast 36 interlock is disconnected when cage assembly 50 assumes a closed configuration securing the operator therewithin, thereby permitting mast 36 to be elevated or retracted.

Figure 7A:
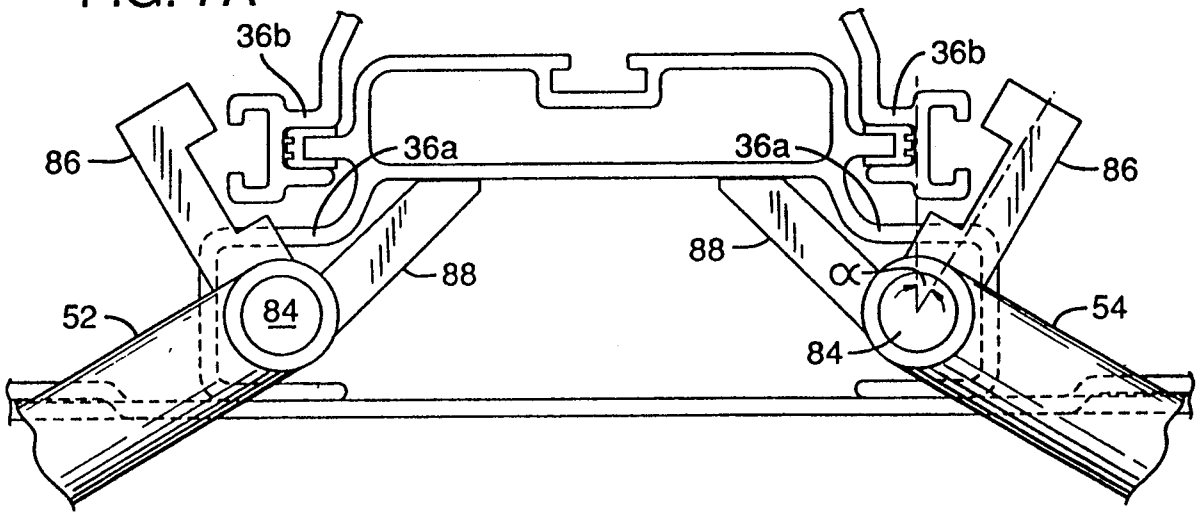
Figure 7B:
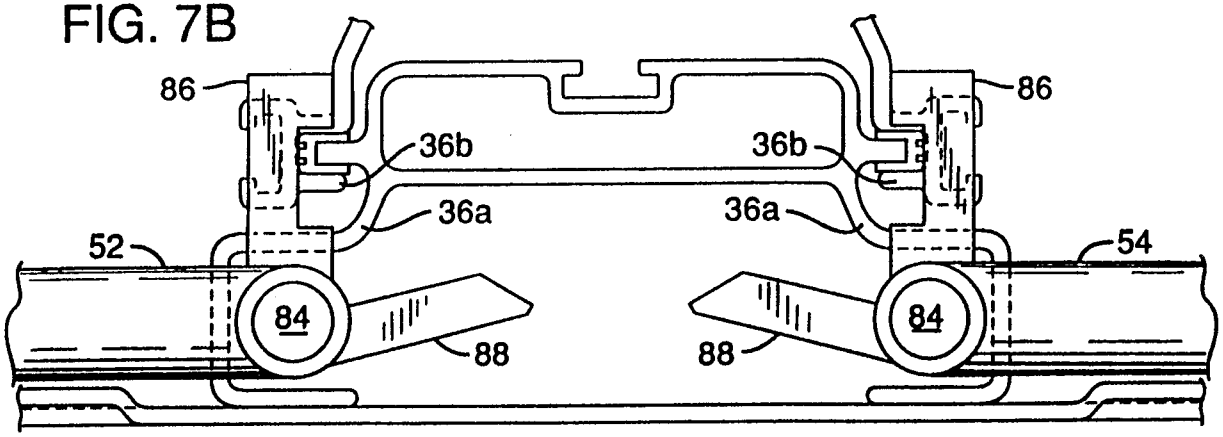
Figure 7C:
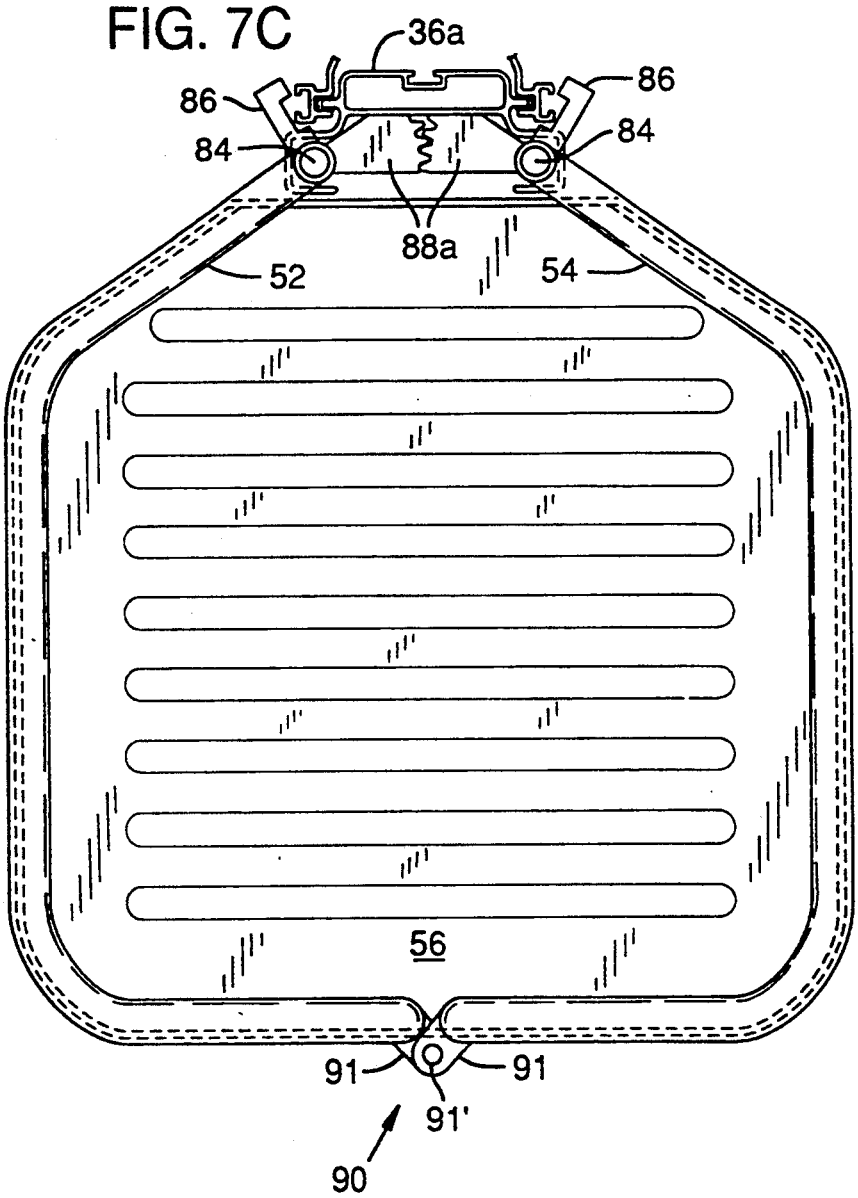
Figure 7D:
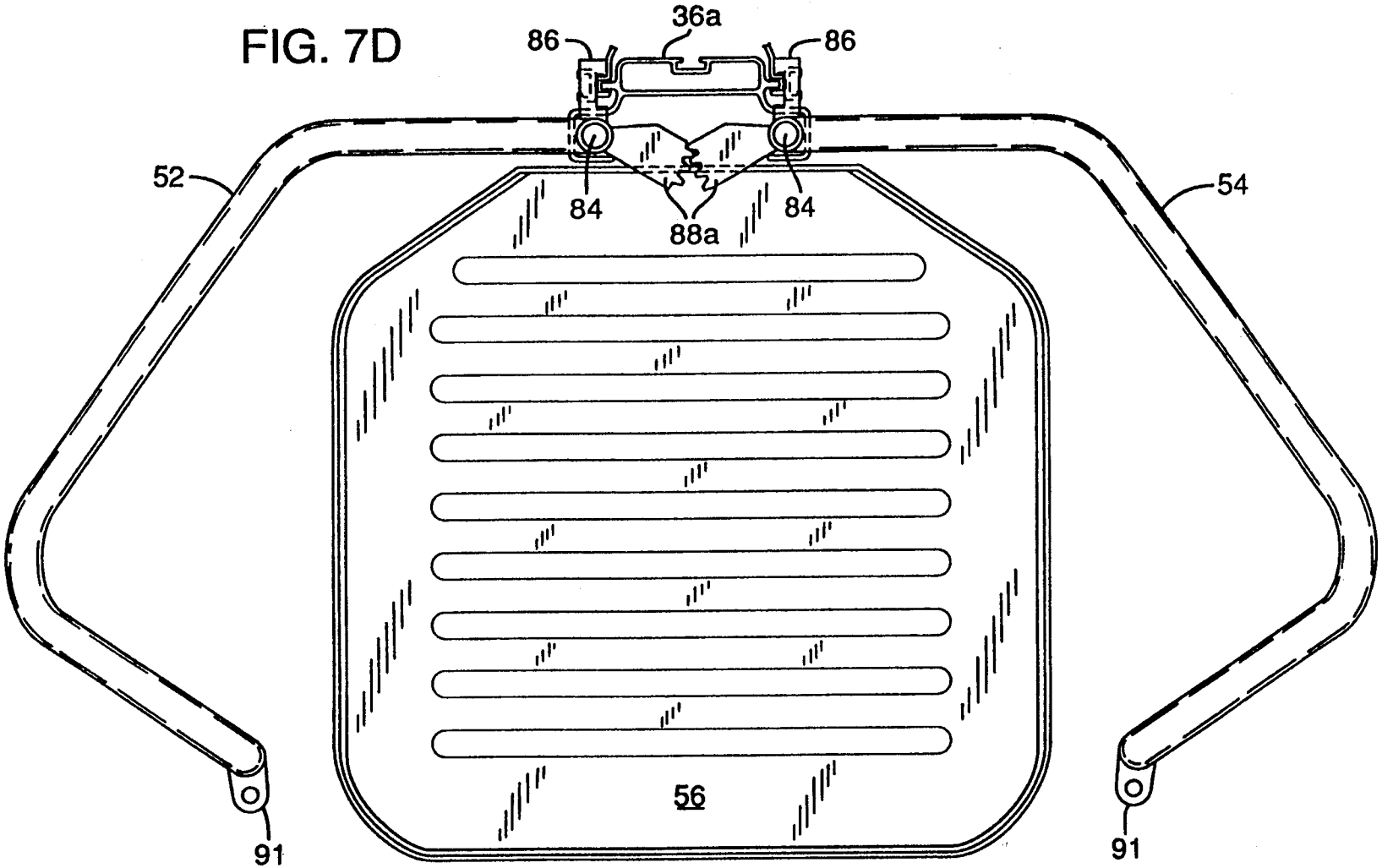

As shown in FIGS. 7*a*-7*d*, pivots 84 are disposed about a vertical axis that is perpendicular to the plane of the Figure. In the embodiment of the present invention shown in FIGS. 7*a* and 7*b*, each pivot 84 and one of guardrail portions 52 and 54 are operably connected to a locking bar 86 and a stop 88. FIGS. 7*c* and 7*d* depict an alternative embodiment of stop 88, a meshing stop 88*a*, which enhances the operational safety of personnel lift device 30. Locking bar 86 constitutes an exemplary fastening means useful in the practice of the present invention. Stops 88 or 88*a* act in cooperation with a latch mechanism 90 (FIG. 6 and FIGS. 7*c* and 7*d*) to place and maintain cage assembly 50 in a closed operable configuration.

Locking bars 86 and stops 88 may be formed from any convenient material, provided that the material is capable of withstanding the forces exerted on these components. For example, locking bars 86 and stops 88 may be formed of steel, aluminum, composites, plastics or the like. These components must be sized and configured to perform their respective functions. Locking bar 86 is sized and configured to fit snugly over the connection between mast stages 36*a* and 36*b*. Stop 88 is sized and configured to engage rear mast stage 36*a* when cage assembly 50 is in a closed configuration. Meshing stops 88*a* are additionally sized and configured to mesh with each other. Any meshing configuration, e.g., square teeth, rounded teeth or the like, may be used. Segment gears, for example, may be employed. Pivots 84, locking bars 86 and stops 88 are affixed to guardrail portion 52 or 54 in any convenient manner known in the art, such that guardrail portion 52 or 54 moves with pivoting motion of pivot 84.

The fastening means of the present invention is preferably designed to provide for a mechanical/electrical mast 36 interlock. Locking bar 86 may, for example, be sized and configured to overlap the connection between the two rear stages of mast 36 (i.e., mast stages 36*a* and 36*b*) when guardrail portions 52 and 54 are positioned in an open configuration, thereby mechanically interlocking mast 36 and preventing cage assembly 50 movement. Any other convenient mechanical interlock may be utilized for this purpose.

Guardrail portions 52 and 54 are designed for manipulation from a full open to a full closed position in combination with pivoting of pivot 84 through an angle. Angle is preferably chosen to allow shaped guardrail portions 52 and 54 to fully enclose an operator therewithin and to make an open cage assembly 50 configuration obvious upon visual inspection. An exemplary angle is about 30°. Guardrail portions 52 and 54 are each spring-loaded in a conventional manner with a torsion spring disposed inside a vertical tube to open to angle if not latched, thereby returning cage assembly 50 into an open, mast interlocked configuration. In addition, stops 88 are disposed in contacting relationship with rear mast stage 36*a* when cage assembly 50 is in closed configuration. In this manner, proper closure of cage assembly 50 by latching mechanism 90 is facilitated.

To close cage assembly 50, the operator pushes guardrail portions 52 and 54 together until locking bar 86-induced mast stage 36*a*/36*b* interlock is disconnected. In addition, the operator is also required to latch guardrail portions 52 and 54 with latch mechanism 90 (FIG. 6). Latch mechanism 90 may be any conventional latch mechanism sufficient to maintain vertical bars 18*c* of guardrail portions 52 and 54 in close proximity to each other. For example, latch mechanism 90 may include two latching portions 91 and latching pin 91' (FIG. 7*c*). When latched, the mechanical interlock between mast stages 36*a*/36*b* is disconnected, permitting mast 36 to be extended and retracted and preventing the operator from opening cage assembly 50. In a mast 36 interlocked configuration (i.e., cage assembly 50 is not elevated), a portion of the structure of mast stage 36*a* is engaged by locking bar 86. When cage assembly 50 is elevated, that structural portion of mast stage 36*a* is displaced in such a manner that locking bar 86 cannot engage therewith. As a result, guardrail portions 52 and 54 cannot be opened more than about 2.0" to 3.0". Consequently, the operator is secured within cage assembly 50 and prevented from accidentally or intentionally opening cage assembly 50 when it is elevated.

Meshing stops 88*a* (FIGS. 7*c* and 7*d*) provide for additional safety in the operation of personnel lift device 30. In the embodiment shown in FIGS. 7*a* and 7*b*, guardrail portions 52 and 54 may be open individually upon the release of latching mechanism 90. Consequently, if latching mechanism 90 is released and one locking bar 86 is broken or otherwise malfunctions and does not provide mast 36/cage assembly 50 mechanical interlock, the guardrail portion 52 or 54 operably connected to the malfunctioning locking bar 86 may open, regardless of whether cage assembly 50 is elevated.

Meshing stops 88*a* prevent guardrail portions 52 and 54 from opening independently. In FIG. 7*d*, meshing stops 88*a* are deployed in a substantially non-meshed configuration when guardrail portions 52 and 54 are in an open configuration. To achieve a closed configuration of guardrail portions 52 and 54, both portions must be moved into closed position, thereby placing meshing stops 88*a* in a meshed configuration (FIG. 7*c*). When this embodiment of the present invention is utilized in the single malfunctioning locking bar 86 scenario described above, the meshed configuration of stops 88*a* prevents the effected guardrail portion from opening. Consequently, a further level of protection for the person enclosed within cage assembly 50 is provided.

The state of the mechanical mast stage 36*a*/36*b* interlock may be monitored and communicated to a control system. For example, the mechanical interlock may be sensed by a communicating device or may directly trip a controller switch. A practitioner in the art would be able to design and implement a control system based upon electrical monitoring of the state of this mechanical interlock.

In operation, an operator enters an embodiment of cage assembly 50 of the present invention deployed in an open configuration (i.e., torsion spring-actuated mast interlock engaged), pushes gate portions 52 and 54 through an angle and employs latch mechanism 86.

Locking bar 86 becomes disconnected from the mast stage 36a/36b connection. A switch designed and configured to respond to mechanical mast interlock is either tripped or disconnected, thereby communicating that cage assembly 50 is closed to the control system. Preferably, the disconnection of the mechanical interlock is also communicated to the operator through a LED indicator or other conventional means. At this time, the operator knows that it is safe to proceed to elevate cage assembly 50 of lift device 30, and the controls thereof will respond to such a command.

The stabilization system of the present invention is shown in FIGS. 2, 3, 8 and 9. As discussed previously, FIGS. 2 and 3 show a preferred embodiment of the stabilization system of the present invention deployed to permit safe use of personnel lift 30. FIG. 8 depicts an exploded view of a portion of base 32 and an outrigger 40. Base 32 may be formed of any convenient material or combination of materials capable of supporting personnel lift 30 throughout its useful life. As a result, durable, strong and stability-enhancing heavier materials are preferred. Exemplary of such materials are steel, aluminum and the like. Base 32 is preferably configured in the six deployment opening 38 configuration described previously and shown in FIG. 3. Other stability enhancing configurations, such as X− or +−four deployment opening 38 configurations, may be similarly employed, however.

Outriggers 40 may be formed of any convenient material or combination of materials capable of imparting structural stability when contacted with the personnel lift 30 deployment surface. Also, outriggers 40 must be manipulable by the operator of personnel lift 30. Consequently, durable light-weight materials are preferred. Exemplary materials are aluminum, steel, composites, and the like. Outriggers 40 may be of any convenient shape, so long as they are capable of fitting loosely within base 32 and of pivoting therewithin until jack 42 is firmly in contact with the personnel lift 30 deployment surface. Outriggers 40 are preferably of substantially the same shape as deployment openings 38 and hollow shafts forming base 32. For example, base 32 may be formed of 5"×2" rectangular steel tubing, and outriggers 40 may be formed of aluminum and designed to provide clearance about the periphery thereof to loosely fit within base 32. For the purposes of this description, the term "loose fit" indicates a fit characterized by at least about 0.125" of space between the outer surface of outrigger 40 and the inner surface of base 32, with about 0.25" vertical clearance and about 0.125" horizontal clearance being preferred. To facilitate operation of personnel lift 30 in the vicinity of vertical walls, outriggers 40 of the present invention are typically shorter than their prior art counterparts. Specifically, a preferred outrigger 40 length is about three feet, with about two feet more preferred.

A jack access passage 108 may also be conventionally machined into outrigger 40 if required to accommodate jack 42. The location of jack access passage 108 is chosen to meet the same goals as the locations of lock-pin access holes 100 and 104. A practitioner in the art would be able to ascertain appropriate locations therefor.

A preferred embodiment of the stabilization system interlock of the present invention is shown in FIG. 9, where the interior surface of base 32 is provided with at least one deployment stop 110. In this embodiment, outrigger 40 is inserted into base 32 until contacting stop 110. Any conventional mechanical stop may be utilized for this purpose, including a simple protrusion or other obstruction within base 32. The location of stop 110 is chosen to facilitate the use of an electrical interlock control system and to provide personnel lift 30 stability in combination with a small outrigger 40 deployment radius.

The small outrigger 40 deployment radius results from decreased outrigger 40 length. Outriggers 40 useful in the present invention need only be long enough to be properly insertable within base 32 and provide deployment surface level stability to personnel lift device 30. As a general rule, the portion of outrigger 40 inserted into base 32 constitutes about one-quarter of the total length of outrigger 40. In a preferred embodiment of the stabilization system of the present invention, about one foot of the 3-foot outrigger 40 will be inserted within base 32.

Even when properly inserted within base 32, outriggers 40 may not impart an adequate degree of stability to personnel lift 30 or other device being stabilized. To achieve such stability enhancement, a jack 42 is disposed at the end of outrigger 40 opposite to the end thereof inserted into base 32. Jack 42 is designed such that rotation of crank 44 results in downward motion (i.e., pivoting) of the end of outrigger 40 to which jack 42 is operably connected. For example, jack 42 may be operably connected to outrigger 40 through a jack access passage 108 (FIG. 8). Alternatively, jack 42 may be formed integrally with outrigger 40. Outrigger 40 pivoting is limited by the vertical clearance within the "loose fit" outrigger 40/base 32 structure.

In addition, a LED or other indicating mechanism may be used to communicate outrigger 40 status information to the operator. A single LED indicator is preferably used to inform the operator whether the entire stabilization system is functional. A multiple LED indication system, including, for example, an LED for each outrigger 40 or deployment hole 38, may alternatively be used.

At least one conventional level (not shown) is additionally provided on base 32 to provide for additional safety enhancement when personnel lift 30 is deployed on an uneven surface. Specifically, maximum stability may be achieved when jack bases 48 of all outriggers 40 firmly contact the ground, such that base 32 and therefore personnel lift 30 are level.

The electrical interlock and control of the stabilization system of the present invention is discussed below in connection with the preferred six deployment opening 38/four outrigger 40 system design. A series/parallel circuit may be employed within the control mechanism to monitor whether outriggers 40 are properly deployed in an appropriate configuration. As discussed previously, outriggers 40 are preferably deployed from the single leftward and rightward deployment openings 38 and from one of two forward and rearward deployment openings 38 disposed at opposite sides of base 32, as shown in FIG. 3. If forward and rearward outriggers 40 are deployed along the same side of base 32 or if outriggers 40 are otherwise deployed in an unbalanced fashion, the control system will not permit cage assembly 50 of personnel lift 30 to be elevated.

When outrigger 40 is merely inserted into base 32 until it impacts at least one stop 110 (FIG. 9a), a pin 120 acts as a cam to maintain outrigger 40 in a non-contacting relationship with a trip device 112. Specifically, outrigger 40 is disposed above a contracting surface 116 of trip device 112. As jack 42 is rotated to achieve contact of jack base 48 with the deployment surface of personnel lift device 30, outrigger 40 is pivoted within base 32, causing pin 120 to insert into locking hole 122 and outrigger 40 to engage contacting surface 116 of trip device 112. Insertion of pin 120 into locking hole 122 interlocks outrigger 40 and base 32, such that outrigger 40 cannot be removed from base 32 until jack 42 is unloaded. Outrigger 40 engagement with contacting surface 116 causes an actuating surface 118 of trip device 112 to close a switch 114. The mechanical interlock is therefore communicated to the electrical system by contact between outrigger 40 and contacting surface 116 that pivots trip device 112 to allow actuating surface 118 to close switch 114. Specifically, outrigger 40 is pivoted through an angle sufficient to close switch 114. Switch overtravel prevents damage thereto. Any other switch closing mechanism, such as a wire mechanism, may alternatively be employed.

Switch 114 is enclosed within base 32 and is therefore protected from breakage and resistant to tampering. Also, switch 114 is designed to travel a distance of from about 0.350" to about 0.375" between its full open and full closed positions, with about 0.375" preferred. Switch 114 is therefore less sensitive and less complex than those previously used to indicate proper outrigger 40 deployment. Six switches 114 are required to provide input for the series/parallel circuit control mechanism of the preferred stabilization system of the present invention. A practitioner in the art would be able to design such a control mechanism and similar control mechanisms for alternative, stable, outrigger 40 deployment configurations.

Stops 110, trip devices 112, switches 114 and pins 120 useful in this embodiment of the present invention are known and commercially available. Moreover, a practitioner in the art would be able to design an electrical/mechanical interlock as described above specific for the intended use thereof. Locking holes 122 may be machined into base 32 using conventional techniques.

In operation, outrigger 40 is inserted into deployment opening 38 and maneuvered into a loose fit within base 32, until outrigger 40 impacts stop 110. Upon outrigger 40/stop 110 contact, jack 42 is operated to secure outrigger 40 (i.e., is turned until jack base 48 firmly contacts the personnel lift 30 deployment surface). During the operation of jack 42, the end of outrigger 40 enclosed within base 32 pivots downward. The combination of outrigger 40 insertion into base 32 and pivoting of outrigger 40 therewithin results in pin 120 insertion into locking hole 122 and the activation of switch 114. These actions both achieve and communicate to the control system the secured status of outrigger 40. Only when all outriggers 40 are locked within base 32 can cage assembly 50 of personnel lift 30 be elevated. Optimally, the status of the outrigger 40 interlocks can be communicated to the operator through the use of LEDs, or similar mechanisms. Specifically, the function of the device requiring the stability imparted by the stabilization system can be performed by the device only when outriggers 40 are inserted within base 32 with jacks 42 properly adjusted.

Mast 36 of the present invention is depicted in FIGS. 3, 10 and 11. Mast 36 may be formed of any material or combination of materials capable of supporting the components to be lifted thereby. Since personnel lifts 30 are designed to be portable and all but front mast stage 36*f* must lift at least one mast 36 stage, durable lightweight materials are preferred. Exemplary of such materials are aluminum, composites, and the like. Mast 36 may be formed by a variety of conventional metalworking techniques, with extrusion processing preferred. Mast 36 of the present invention is preferably formed in conventional extrusion processes.

Mast 36 of the present invention may include from about one to about eight telescoping stages and one fixed stage. Preferably, mast 36 includes from about two to about six stages. The number of mast 36 stages is limited by the stage dimensions, stability considerations, total height requirements, construction materials and the like. A practitioner in the art would be able to determine an appropriate number of mast 36 stages.

An exemplary mast 36 stage of the present invention is from about 60" to about 100" long; from about 6" to about 12" wide; and from about 8" to about 18" thick. A five telescoping stage mast 36 of the present invention provides a maximum cage assembly 50 elevation of from about 25' to about 35'.

A preferred embodiment of mast 36 has the shape shown in FIG. 10. Specifically, each telescoping mast stage 36*b*, 36*c*, 36*d*, 36*e* and 36*f* is characterized by a tee slot 130 formed on the left sides, right sides, and rear sides thereof, facing leftward, rightward, and rearward, respectively (i.e., the tee slot opens in the direction indicated). Tee slots 130 may be formed of any convenient dimensions. Exemplary tee slot dimensions are from about 0.75" to about 1.25" for a cross length wall 140; from about 0.25" to about 0.50" for a cross width wall 142; from about 0.150" to about 0.250" for a stem length wall 144; and from about 0.50" to about 0.750" between stem length walls 144, as indicated by distance d in FIG. 11. Preferred tee slot dimensions are about 1.0" for cross length wall 140, about 0.315" for cross width walls 142, about 0.250" for stem length walls 144, and about 0.563" between stem length walls 144.

Tee slots 130 decrease machining requirements and promote ease of component attachment as well as facilitate maintenance of personnel lift 30. Specifically, components may be mounted on the exterior of mast 36 through the use of tee nuts rather than through the use of screws or other attachment devices, which require holes to be machined into mast 36. A decrease in required machining results in easier and more rapid personnel lift 30 assembly during the manufacturing process.

Attachment of personnel lift device 30 components that require maintenance to the exterior of mast 36 provides easy access to such components. In addition, simplicity in component-mast 36 attachment facilitates the maintenance process. Maintenance time can be decreased, because lift device 30 may be maintained without at least partial disassembly thereof. For example, cable sheaves may be mounted on the outside of mast 36 and are therefore easily adjustable. By providing for enhanced cable access, the design of the present invention facilitates maintenance of proper cable tension.

Each fixed or telescoping mast stage 36*a–f* is characterized by protrusion 132, as shown in FIG. 10. Each protrusion 132 is configured to fit loosely within a substantially U-shaped slot 134 formed integrally with and oriented oppositely to tee slot 130 (i.e., rightwardly opening tee slots 130 are formed integrally with leftwardly opening U-slots 134).

Protrusions 132 may be formed of any convenient shape and dimensions. A preferred protrusion 132 shape is substantially rectangular. Rectangular protrusion 132 dimensions are from about 0.50" to about 1.0" in length and from about 0.25" to about 0.50" in width. Preferred dimensions are about 0.5" in length and 0.25" in width.

U-slots 134 may be formed of any convenient dimensions, provided that rectangular protrusions 132 fit loosely therein. As shown best in FIG. 11, U-slot 134 dimensions are from about 0.50" to about 0.75" for a base wall 146; from about 0.50" to about 1.0" for a free wall 148; and from about 0.625" to about 1.125" for a connected wall 150. Connected wall 150 extends to form protrusion 132 of the next adjacent mast 36 stage. Preferred U-slot 134 dimensions are about 0.50" for base wall 146, about 0.50" for free wall 148, and about 0.625" for connected wall 150.

For example, protrusion 132 of 0.50" length and 0.250" width fits within U-slot 134, having a 0.50" base wall 146, a 0.50" free wall 148 and a 0.625" connected wall 150. Mast 36 of the present invention may also include protrusions 132 of other than substantially rectangular shape, provided that such protrusions 132 fit loosely within U-slots 134 and are capable of slidable interconnection therewith in a manner analogous to that described below. Moreover, U-slots 134 may be replaced with another structure capable of loosely housing protrusions 132 and slidable interconnection therewith in a manner analogous to that described below. A practitioner in the art would be able to design an appropriate mast 36 structure.

In any event, protrusion 132 and U-slot 134 structural configurations or structures analogous thereto facilitate manufacturing of mast 36 of the present invention. Specifically, the stages of mast 36 may be interconnected without the necessity of machining to permit the use of fastening devices, such as screws or the like.

In addition, protrusions 132 located on rear mast stage **36*a* provide a means to attach a component to the rear of personnel lift 30. Specifically, the component to be attached can be formed integrally with or be operably connected to a structure designed to fit over protrusions 132 on rear mast stage 36*a***. This fit may either be loose or tight, depending on the component being affixed.

Disposed between rectangular protrusions 132 and U-slots 134 is at least one strip of low-friction material 136. Exemplary low-friction materials are NYLATRON®, polyethylene, and the like, with NYLATRON® being preferred. In a preferred embodiment of mast 36 of the present invention, low-friction strips 136 are disposed along the entire contact area between protrusions 132 and U-slots 134. In this manner, protrusions 132 and U-slots 134 are more snugly fitted in sliding contact with one another. Specifically, protrusions 132 are capable of sliding within U-slots 134 during elevation and retraction of telescoping mast 36.

In another preferred embodiment of the present invention, two low-friction strips 136 are utilized. One low-friction strip 136 is disposed along the upper portion of the length of each telescoping mast 36 stage, while the second low-friction strip 136 is disposed along the lower portion. In this manner, sliding engagement is achieved between protrusions 132 and U-slots 134 through the use of less low-friction material. In this embodiment, low friction strips 136 of a length of from about 6" to about 12" may be utilized, with strips 136 of about 6 inches in length being preferred for mast stages of a length from about 60" to about 100".

Sliding engagement provides structural stability and decreases structural stress by providing a large effective protrusion 132/U-slot 134 contact area. Also, sliding elevation and retraction may be achieved with less machining than the roller-based telescoping mechanisms used in the prior art.

Other portions of the structure of telescoping mast 36 are conventional. For example, chains 137 operate in cooperation with hydraulic cylinder 138 in elevating and retracting mast 36.

The transfer apparatus of the present invention is shown in FIGS. 4, 12, 13 and 14. FIG. 4 shows the primary components of the transfer apparatus (i.e., lower wheels 34, upper wheels 64 and transfer bumper 62). Lower wheels 34 provide for movement of personnel lift device 30 along the surface upon which it is deployed. Wheels conventionally employed for the same or similar purposes may be utilized as lower wheels 34. The dimensions of wheels 34 will be dictated by the characteristics, such as the weight, of the device to be transferred, the size of the other primary components of the transfer apparatus and the like. A practitioner in the art would be able to select appropriate wheels 34.

Upper wheels 64 act in cooperation with lower wheels 34 in moving personnel lift device 30 along a surface, such as the bed of a truck, that is raised above the deployment surface during transportation or storage of personnel lift device 30. Wheels conventionally employed for the same or similar purposes may be utilized as upper wheels 64. The dimensions of wheels 64 will be dictated by the characteristics, such as the weight, of the device to be transferred, the size of the other primary components of the transfer apparatus and the like. Exemplary upper wheels 64 are 6"×2" wheels. A practitioner in the art would be able to select appropriate wheels 64.

Transfer bumper 62 may be composed of any convenient material and is preferably composed of a high-friction material, such as rubber, neoprene, and the like. Any shape that facilitates the transfer operation may be employed for transfer bumper 62. An exemplary preferred shape, a modified rectangle, is shown in FIG. 4. The modified rectangular configuration involves a curved rather than flat bumper 62 surface opposite the bumper 62 surface that is adjacent to mast 36.

One of the features of personnel lift 30 of the present invention is that no essential structure is disposed in a manner that obstructs the transfer operation. Some prior art devices, for example, are configured such that the battery pack is disposed along the rear of the device and must therefore be removed prior to transfer. No additional component removal step must be conducted in transfer operations accomplished in accordance with the present invention.

FIG. 12 is a schematic representation of a side view of a transfer apparatus 160 of the present invention. Transfer apparatus 160 includes lower wheels 34, upper wheels 64, a transfer bumper 62, a transfer bumper mount and a transfer bumper stop (FIG. 14). To facilitate transfer between essentially horizontal surfaces displaced from each other by a variety of heights (i.e., distances), transfer bumper 62, a mount therefor (shown in FIG. 11 as a pivot 162 and a carriage 164) and a stop therefor (FIG. 14) are releasably lockable at a plurality of positions along the rear of mast 36. For example, rear mast stage **36*a* may be designed to stop transfer pivot 162 at heights of 24", 30" and 36" above a deployment surface 166. In this manner, vehicles having tailgate heights ranging from about 24" to about 36" may be used to transport personnel lift device 30. In FIG. 12, variable height stops of transfer pivot 162 are shown as a set of three simple mechanical stops 168** located at the relevant heights.

To achieve a variable-height, releasably lockable configuration, conventional mechanical stops may be used, provided that such stops can be bypassed in accordance with the requirements set forth below (i.e., transfer pivot 162 is releasably locked). Known pivot carriage structures may be employed in the pivot 162/carriage 164 embodiment of the present invention. A practitioner in the art would be able to select appropriate components for that purpose. In addition, any other affixation means capable of releasably locking transfer pivot 162 may be employed. Also, other transfer bumper 62/mount structures may be employed in the transfer apparatus of the present invention, provided that such structures are releasably lockable.

In the pivot 162/carriage 164 embodiment of the present invention, pivot 162 is preferably formed, either in whole in or part, of a high-friction material such as rubber, neoprene, and the like. In this manner, transfer pivot 162 will facilitate pivoting rather than sliding motion of personnel lift device 30 during the transfer operation. Specifically, the friction between pivot 162 and the substantially horizontal surface to which personnel lift device 30 is being transferred converts the lifting force applied to personnel lift 30 into pivoting motion thereof.

A preferred releasably locking transfer bumper mount 170 of the present invention is shown in FIG. 13. Transfer bumper mount 170 is designed to be releasably positioned at any height within a specified range. A preferred transfer bumper mount 170 is releasably positioned at any height above deployment surface 166 up to about 36". This embodiment of transfer bumper mount 170 includes a bar 171 affixed to a roller assembly 172 by any convenient means, including a plurality of cap screws 174. The transfer bumper 62 (shown in FIG. 4) is affixed to transfer bumper mount 170 through bar 171. Roller assembly 172 includes a plurality of rollers 176, a track 177, a roller bolt 178 for each roller 176 and an attachment means 180. A tee nut 182/spring 184/shoulder bolt 186 assembly functions in cooperation with roller assembly 172 to permit transfer bumper mount 170 to move when the weight of the device being transferred is on bumper 62. (FIG. 3, FIG. 12). This weight transfer is accomplished by the transfer mechanism of the present invention by rotating rather than lifting the device being transferred.

Transfer bumper mount 170 is locked at an initial height through adjusting transfer bumper 62 so that it rests on the edge of the upper, substantially horizontal surface to which personnel lift device 30 is to be transferred. When rotation of personnel lift 30 is commenced, the weight thereof will be borne by transfer bumper 62, thereby releasing transfer bumper 62.

Bar 171 may be composed of any material or combination of materials capable of being mounted to personnel lift device 30 and transfer bumper 62. In addition, bar 171 must be capable of supporting transfer bumper 62 during the transfer operation (i.e., rotation of personnel lift device 30). As a result, durable strong materials, such as steel, aluminum, and the like, are preferred. Bar 171 may be constructed to have a surface area coextensive with that of the surface of transfer bumper 62 adjacent thereto. Alternatively, bar 171 may have a larger or smaller surface area than the portion of bumper 62 in a parallel adjacent relationship therewith.

Bar 171 may be affixed to roller assembly 172 by any conventional means therefor. For example, bar 171 may be affixed to attachment means 180 through the use of cap screws 174, as shown in FIG. 13. Such cap screws 174 and analogous structure are known and commercially available.

Rollers 176 useful in the present invention are also known and commercially available. A plurality of rollers 176 are employed in this embodiment of transfer bumper mount 170, with four rollers 176 being preferred. Rollers 176 may be constructed of any material or combination of materials conventionally employed in roller/track assemblies of this type. In addition, rollers 176 may be of any convenient dimensions, provided that rollers 176 are sized and configured to cooperate with track 177. A roller 176 configuration capable of using protrusions 132 as tracks 177 is preferred in an alternative embodiment of the present invention discussed in greater detail below. When the weight of personnel lift 30 is transferred to transfer bumper 62, rollers 176 will contact a track 177, and roll freely therealong, thereby allowing transfer bumper 62 to move along the length of rear mast stage 36*a*.

Track 177 may be of any size and configuration, provided that a portion thereof is shaped to permit rollers 176 to move therealong. In addition, track 177 must be of a length sufficient to allow transfer bumper mount 170 to move throughout its area of operation, as that area is more fully described below. In the embodiment shown in FIG. 13, track 177 is formed integrally with a structure having a tee slot 130 to facilitate releasable locking of transfer bumper mount 170. In this embodiment, track 177 may also be formed integrally with rear mast stage 36*a*. Alternatively, track 177 may correspond to protrusions 32 located on rear mast stage 36*a*.

Attachment means 180 interconnects roller assembly 172 and the releasing assembly (shown in FIG. 13 as tee nut 182, spring 184 and shoulder bolt 186). Any material or combination of materials may be utilized to form attachment means 180, provided that attachment means 180 is configured to accommodate the components of the two assemblies to be attached. In FIG. 13, attachment means 180 is depicted as an elongated U-shaped component capable of accommodating cap screws 174, roller bolts 178, springs 184 and shoulder bolts 186.

The releasing assembly of the present invention acts to release transfer bumper 62 from its locked position upon the transfer of the weight of the personnel lift device 30 to bumper 62. As shown in FIG. 13, the releasing assembly includes tee nut 182, spring 184 and shoulder bolt 186. Preferably, two of each of these components are employed within the releasing assembly. Analogous weight bearing component-actuated releasing mechanisms may also be used in accordance with the present invention.

Tee nuts 182 useful in the present invention are known and commercially available. In addition, other conventional means to mount a compression spring, such as spring 184, may alternatively be employed.

Springs 184 useful in the present invention are also known and commercially available. When the weight of personnel lift device 30 is on transfer bumper 62, spring 184 is placed under load (i.e., shoulder bolt 186 actuates the straightening of spring 184) and therefore straightens. When spring 184 straightens, tee nut 182 is free to move in tee slot 130. When the weight of personnel lift device 30 is transferred to wheels 34, the load is removed from spring 184, which then returns to its bent configuration. This reconfiguration of spring 184 creates friction between tee nut 182 and tee slot 130 which, in turn, forms an air gap between rollers 176 and track 177, thereby holding transfer bumper mount 170 in position. In addition, other beveled or compression springs or analogous devices may alternatively be employed.

Shoulder bolts 186 useful in the present invention are known and commercially available. When the weight of personnel lift device 30 is on the transfer bumper 62, it presses against bar 171 which, in turn, presses against shoulder bolts 186. Shoulder bolts 186 then contact springs 184, causing springs 184 to straighten.

A limiting assembly 200, shown in FIG. 14, is utilized to limit transfer bumper 62 movement. Any other movement limiting apparatus adaptable to use in cooperation with transfer bumper 62 may be used in the practice of the present invention.

Limiting assembly 200 is positioned above transfer bumper 62 to prevent transfer bumper 62 from moving vertically upward along rear mast stage 36*a*. A plurality of locking holes 202 is provided on crosslength wall 140 of rear tee slot 130 of rear mast stage 36*a*. Locking holes 202 may be formed in conventional machining processes and are characterized by a diameter of from about 0.25" to about 0.50", with about 0.50" being preferred. Exemplary distances from deployment surface 166 for locking holes 202 are 28", 34" and 40"; however, any other convenient height(s) may be used.

An interiorly threaded tee nut 204 operates in cooperation with a partially exteriorly threaded lockpin 206 and rear tee slot 130 located on rear mast stage 36*a* to limit transfer bumper 62 movement. Commercially available tee nuts 204 may be employed in the practice of the present invention. Lockpin 206 includes a locking protrusion 208, an exteriorly threaded cooperating portion 210, a stop portion 212, a stem 214 and a knob 216. As shown in FIG. 15, externally threaded cooperating portion 210, stop portion 212, and stem 214 may be formed integrally. Commercially available lockpins 206 may be employed in the practice of the present invention.

Locking protrusion 208 is preferably sized and configured to be insertable through tee nut 204 without contacting the internal threads thereof and to fit loosely within locking hole 202. An exemplary diameter for locking protrusion 208 is about 0.375". Exteriorly threaded cooperating portion 210 is sized and configured to cooperate with interiorly threaded tee nut 204 to more securely affix lockpin 206 in position. An exemplary length for externally threaded contacting portion 210 is about 0.375".

Stop portion 212 constitutes the segment of lockpin 206 that contacts transfer bumper 62 and prevents its motion in the restricted direction (i.e., upward along rear mast stage 36*a*). As a result, stop portion 212 is sized and configured to sustain impact with transfer bumper 62 as well as the forces subsequently exerted by transfer bumper 62 in an effort to move in the restricted direction. An exemplary length for stop portion 212 is about 0.375".

Stem 214 operably connects knob 216 with impact portion 212. An exemplary length for stem 214 is about 0.75". As shown in FIG. 15, impact portion 212 and cooperating portion 210 are integrally formed with stem 214. FIG. 15 depicts the internal structure of lockpin 206, including a bar 220 having a threaded end 222 and having a spring 224 deployed therearound. Knob 216 is configured to cooperate with threaded end 222 of bar 220, and to facilitate lockpin 206 use. Knob 216 may be of any convenient size, e.g., a sphere having an 0.75" radius. Bar 220 is sized and configured to cooperate with knob 216 (through threaded end 222), spring 224 and protrusion 208. Spring 224 is sized and configured for disposition about bar 220 and to provide a 0.50" stroke to protrusion 208. Specifically, rotation of knob 216 results in the adjustment of protrusion 208 position relative to externally threaded contact portion 210.

In operation, personnel lift device 30 is maneuvered into a position adjacent to the upper, substantially horizontal surface to which it is to be transferred through the operation of lower wheels 34. Transfer bumper 62 is adjusted so that it rests on the edge of the upper, substantially horizontal surface. Limiting assembly 200 is then utilized to limit transfer bumper 62 movement along rear mast stage 36*a* to a single direction (i.e., downward along rear mast stage 36*a*). Specifically, the appropriate locking hole 202 is selected, depending upon the distance separating the upper and lower substantially horizontal surfaces between which personnel lift device 30 is being transferred. Tee nut 204 is placed within tee slot 130 at a location where the interiorly threaded portion thereof is flush with the selected locking hole 202. Lockpin 206 is then operably connected with tee slot 130 and tee nut 204, such that locking protrusion 208 is inserted within locking hole 202 and exteriorly threaded portion 210 cooperates with interiorly threaded tee nut 204. These two tasks (i.e., tee nut 204 placement and lock pin 206 connection) may be accomplished in one easy sliding operation. Rotation of personnel lift 30 is then commenced, thereby subjecting transfer bumper 62 to a load and releasing transfer bumper mount 170. Upon completion of personnel lift device 30 rotation, personnel lift device 30 is pushed along the upper, substantially horizontal surface, with the load remaining on transfer bumper 62.

As personnel lift device 30 is maneuvered along the upper, substantially horizontal surface, transfer bumper 62 moves toward lower wheels 34 along the length of rear mast stage 36*a* through roller 176/track 177 contact. When personnel lift device 30 has been loaded (i.e., lower wheels 34 have impacted the upper, substantially horizontal surface, and the load has been removed from transfer bumper 62), transfer bumper 62 has rolled along track 177 toward wheels 34 to a new position. Transfer bumper 62 therefore becomes fixed at the position it occupied when wheel 34/upper surface contact was made. In this manner, personnel lift device 30 may be transferred in the reverse direction (from the upper, substantially horizontal surface to a lower surface) by performing the above operation in reverse, without the necessity for any component adjustment by the transferor.

FIG. 16 depicts three views of an embodiment of a dual hand operated control mechanism 230 of the present invention. Control mechanism 230 provides safe and easy to use positional control. When used with personnel lift device 30, for example, control mechanism 230 provides up, down and stop control capability.

Control mechanism 230 may be pneumatic, hydraulic or electrical in design. An exemplary control mechanism 230 of the present invention employs 12 volt direct current electric energy in the control circuit. In addition, redundancy must be built into control mechanism 230 to ensure that a single malfunction thereof will not result in a total control loss.

Exemplary control mechanisms 230 useful in the practice of the present invention include a hand guard 232; a set of two actuators 234; a set of two guide pins 236; a set of two handgrips 238; a set of four electric "on/off" switches 240 (designated 240*a* and 240*b* in FIG. 16); a set of two pivots 242; an electrical "stop" switch 244; and a housing 246. Each component of such control mechanism 230 is known and commercially available.

Hand guard 232 is disposed along the upper surface of control mechanism 230. Hand guard 232 may be formed of any convenient material, such as aluminum or the like, and may be of any size and configuration sufficient to protect the hands of an operator during use of control mechanism 230.

Actuators 234 serve to actuate switches 240. Actuators 234 provide an operable connection between handgrips 238 and switches 240, such that when handgrips 238 are manipulated in certain ways, specific switches are closed. Any mechanism capable of serving this purpose may be utilized within control mechanism 230 of the present invention, with resilient members being preferred. Exemplary resilient member actuators 234 are flat springs, and the like. Such resilient member actuators 234 are sized and configured to accomplish the aforementioned task. In addition, resilient member actuators 234 may be formed of any material possessing sufficient resiliency and preferably, wear resistance, such as plastics, DELRINÛ (i.e., acetal) and the like. A practitioner in the art would be able to select appropriate actuators 234.

The control mechanism of the present invention has three primary switch 240 configurations, "rest," "up," and "down." When switches 240 are deployed in these primary configurations, the device being controlled by control mechanism 230 will remain stationary, elevate or retract, respectively. If switches 240 are in a non-primary configuration (e.g., the operator is not using both hands to operate the device), the device being controlled will remain stationary.

Switches 240 useful in the present invention include those designed to be mechanically closed. Exemplary switches 240 are SPDT (i.e., single pole, double throw) electrical "on/off" switches. Switches 240 are normally closed and held open by actuators 234. When personnel lift device 30 is at rest, switches 240 are under tension to hold switches 240 open. As a result, force exerted on actuators 234 in the "up" direction results in the closing of switches 240*a*. Force directed in the "down" direction, on the other hand, results in closure of switches 240*b*. An electrical circuit diagram showing this exemplary switch 240 configuration is shown in FIG. 17. The following truth table applies to that circuit diagram.

Also, the positive and negative terminals of a power supply P (e.g., a battery) are open circuited in the rest condition. Finally, terminals $T_1$ and $T_2$ of a motor M (e.g., a DC motor) are short circuited in the rest condition.

TRUTH TABLE

| | $SW_1$ (240a) | $SW_2$ (240b) | Motor $T_1$ | Motor $T_2$ |
|---|---|---|---|---|
| Rest | Normally Closed | Normally Closed | ground | ground |
| | Held Open | Held Open | V+ | ground |
| Up | Closed | Open | ground | V+ |

TRUTH TABLE-continued

| | $SW_1$ (240a) | $SW_2$ (240b) | Motor $T_1$ | Motor $T_2$ |
|---|---|---|---|---|
| Down | Open | Closed | | |

The four switches 240 are deployed in two sets, designated 240*a* and 240*b* in FIGS. 16 and 17. Switches 240*a* are wired in series. As a result, the operator of control mechanism 230 must actuate both switches 240*a* to cause control mechanism 230 to output an "up" signal. An up signal results in elevation of mast 36 of personnel lift device 30. Specifically, when both switches 240*a* are activated, the circuit is completed with the positive terminal of power supply P applied to terminal $T_1$ of motor M (i.e., current flows from $T_1$ to $T_2$). Similarly, switches 240*b* are wired in series. When both switches 240*b* are actuated, control mechanism 230 will output a "down" signal, thereby retracting mast 36 of personnel lift device 30. When both switches 240*b* are actuated, the circuit is completed with the positive terminal of power supply P applied to terminal $T_2$ of motor M (i.e., current flows from $T_2$ to $T_1$).

Up switches 240*a* and down switches 240*b* are wired in parallel with each other and in series with stop switch 244, as shown in FIG. 17. In this manner, upward and downward motion of personnel lift device 30 are mutually exclusive. Both upward and downward motion may be halted by the operator by actuation of stop switch 244, however. Because both switches 240*a* or 240*b* must be actuated to produce a control mechanism 230 movement output signal, the operator thereof must utilize both hands to operate control mechanism 230. When used with personnel lift device 30, the dual hand requirement enhances the safety of lift 30 operation. Specifically, this design of control mechanism 230 increases the likelihood that the majority of operator's mass as well as the operator's center of mass will be located within cage assembly 50. This disposition of the operator's mass enhances the stability of personnel lift 30 when it is in motion.

Guide pins 236 extend from the front to the rear of control mechanism 230 and are held in place by a set of two fasteners 248. Guide pins 236 useful in the present invention are sized and configured to provide a "track" for the movement of handgrips 238 and may therefore be formed in any convenient shape. Guide pins 236 may be formed of any material capable of withstanding the forces exerted on handgrips 238 and directing that force along a path of motion defined by the structure of guide pin 236. Exemplary materials are aluminum, steel, and the like, with aluminum being preferred.

Handgrips 238 useful in the present invention are disposed about the portion of the outer surface of guide pins 236 located between actuators 234. Handgrips 238 are sized and configured to provide a loose or, preferably, snug fit about guide pins 236 and are formed from any convenient material. Preferably, handgrips 238 are formed from a material that is capable of disposition about guide pins 236 and is comfortable with respect to the hands of the operator of control mechanism 230. Exemplary materials for such handgrips are soft plastic, rubber, and the like, with soft plastic being preferred.

Pivots 242 are located at the approximate midpoint of actuator 234 and are affixed to housing 246. Resilient member actuators 234 are resiliently deformed about pivots 242 through the application of force to handgrips 238 by the operator. Any structure useful as a pivot may be employed in control mechanism 230 of the present invention. Pivot 242 may therefore be formed of any convenient material and sized and configured in any convenient manner. A bolt and standoff pivot 242 is depicted in FIG. 16 as an exemplary pivot 242 structure. A practitioner in the art would be able to select appropriate pivot 242 structures.

The arrangement of a preferred embodiment of the present invention, including actuators 234, guide pins 236, handgrips 238 and switches 240, provides for operator override of certain control mechanism 230 malfunctions. Because of the preferred structure of actuator 234 and rest configuration of switches 240, the operator can manually override control mechanism 230 if all switches 240 become stuck in an open or closed (i.e., "up" or "down" signal generating) configuration. By exerting force on handgrips 238 in the direction opposite that of the direction force had been previously exerted in generating the stuck switch, the operator can break the stuck circuit, rather than relying on the resilient properties of actuators 234 to accomplish that task.

Stop switches 244 useful in the present invention include SPST (i.e., single pole, single throw) switches. Stop switch 244 is preferably wired to a stop button 250 located on the front face of control mechanism 230. Stop switch 244 provides an additional circuit break for use primarily in emergency situations. Stop button 250 may be actuated easily and rapidly in such situations. Because all switches 240 are wired in series with stop switch 244, depression of stop button 250 results in an open circuit (i.e., a disconnection of motor M) and a halt in the movement of the device being controlled by control mechanism 230.

Housing 246 encloses and protects the components contained therein from impact damage and tampering. Also, housing 246 serves as a mount for pivots 242 and fasteners 248. Housing 246 may be sized and configured in any manner sufficient to accommodate the components to be housed, with a substantially rectangular shape, as shown in FIG. 16, preferred. In addition, housing 246 may be composed of any material capable of withstanding the forces exerted thereon, with lightweight durable materials, such as aluminum and the like, preferred.

In operation, an operator enters cage assembly 50 of personnel lift device 30 and eliminates the mechanical interlock preventing elevation of the cage assembly 50 by positioning guardrail portions 52 and 54 in a closed configuration. The operator then grasps control mechanism 230 by both handgrips 238 and exerts force in the upward direction with both hands. Actuators 234 bend to open switches 240*a*, thereby signalling the elevation of personnel lift device 30. When personnel lift 30 completes the desired upward movement, the operator releases handgrips 238, and actuators 234 return to their original configurations, thereby returning the control circuit to its rest configuration and halting the movement of personnel lift device 30.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

What is claimed is:

1. A personnel lift device capable of safely and securely elevating an operator to a desired height above a deployment surface, the lift comprising:

an operator platform;

a cage assembly operably connected to the platform, allowing the operator access to the platform when the cage assembly is in an open configuration and safely and securely enclosing the operator within the cage assembly when the cage assembly is in a closed configuration; and interlocking means capable of permitting the cage assembly to be elevated only when the cage assembly is in a closed configuration and not permitting the cage assembly to assume an open configuration when elevated.

2. A personnel lift device according to claim 1 wherein the cage assembly comprises:

a set of two guardrail portions;

a latch means operably connected to the guardrail portions and capable, when engaged, of securing and maintaining the guardrail portions in a closed configuration; and a biasing member operably connected to each guardrail portion and capable of disposing the guardrail portion into an open configuration if the latch means is not engaged.

3. A personnel lift device according to claim 2, wherein the latch means comprises:

a latching mechanism affixed at one end of each guardrail portion;

a locking bar operably connected at an opposed end of each guardrail portion and capable of interlocking the cage assembly with the personnel lift device; and a stop operably connected to the opposed end of each guardrail portion and capable of limiting movement of the guardrail portion.

4. A personnel lift device according to claim 3, comprising two stops capable of meshing with each other, thereby requiring movement of both guardrail portions to alter the cage assembly configuration.

5. A personnel lift device according to claim 1 further comprising:

electrical monitoring means capable of monitoring status of the interlocking means; and control means in communication with the monitoring means and capable of controlling personnel lift device movement in response to input received from the monitoring means.

6. A personnel lift device according to claim 1 wherein the open configuration and the closed configuration of the cage assembly are displaced through an angle of about 30°.

* * * * *